US007618233B2

(12) United States Patent
Parker et al.

(10) Patent No.: US 7,618,233 B2
(45) Date of Patent: Nov. 17, 2009

(54) HIGH EFFICIENCY AIR CONDITIONER CONDENSER FAN WITH PERFORMANCE ENHANCEMENTS

(75) Inventors: Danny S. Parker, Cocoa Beach, FL (US); John Sherwin, Cocoa Beach, FL (US); Bart Hibbs, Simi Valley, CA (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 529 days.

(21) Appl. No.: 11/367,829

(22) Filed: Mar. 3, 2006

(65) Prior Publication Data

US 2006/0177306 A1 Aug. 10, 2006

Related U.S. Application Data

(63) Continuation-in-part of application No. 10/400,888, filed on Mar. 27, 2003, now Pat. No. 7,014,423.

(60) Provisional application No. 60/369,050, filed on Mar. 30, 2002, provisional application No. 60/438,035, filed on Jan. 3, 2003.

(51) Int. Cl.
*F01D 5/00* (2006.01)

(52) U.S. Cl. ..... 415/119; 416/224; 416/241 A

(58) Field of Classification Search ..... 415/119, 415/219.1; 416/224, 241 A, 241 R, 245 R, 416/229 R, 229 A See application file for complete search history.

(56) References Cited

U.S. PATENT DOCUMENTS 2,638,757 A 5/1953 Borgerd ..... 62/140
3,799,128 A * 3/1974 Small ..... 123/41.49
3,995,442 A 12/1976 Cavezza ..... 62/259
4,251,189 A * 2/1981 Zinsser et al. ..... 416/240
4,470,271 A * 9/1984 Draper et al. ..... 62/259.1
4,526,506 A 7/1985 Koger ..... 415/98

(Continued)

OTHER PUBLICATIONS

Mehdi R. Khorrami, Fei Li and Meelan Choudhari, 2001. "A Novel Approach for Reducing Rotor Tip Clearance Induced Noise in Turbofan Engines" NASA Langley Research Center, American Institute of Aeronautics and Astronautics, 7th AIAA/CEAS Aeroacoustics Conference, Maastrictht, Netherlands, May 28-30, 2001.*

(Continued)

*Primary Examiner*—Edward Look
*Assistant Examiner*—Aaron R Eastman
(74) *Attorney, Agent, or Firm*—Brian S. Steinberger; Law Offices of Brian S. Steinberger, P.A.

(57) ABSTRACT

Conical diffusers with or without conical center bodies can improve air moving performance by up to 21% at no increase in power. Embodiments coupled with electronically commutated motors (ECMs) showed additional reductions to condenser fan power of approximately 25%. A strip member, such as open cell foam can be applied as a liner to the interior walls of a condenser housing adjacent to the wall surface where the rotating blades sweep against. The porous edge can also be used with the trailing edge and/or tip edge of the blades. These members can both improve air flow by reducing dead air spacing between the rotating blade tips and the interior walls of the condenser housing, as well as lower undesirable noise sound emissions.

12 Claims, 24 Drawing Sheets

U.S. PATENT DOCUMENTS

| | | | | | |
|---|---|---|---|---|---|
| 4,832,633 | A | * | 5/1989 | Corlett | 440/67 |
| 4,971,143 | A | | 11/1990 | Hogan | 165/122 |
| 4,971,520 | A | | 11/1990 | Van Houten | 416/169 |
| 5,000,079 | A | * | 3/1991 | Mardis | 454/184 |
| 5,320,493 | A | | 6/1994 | Shih | 416/223 |
| 5,369,836 | A | * | 12/1994 | Horne | 15/210.1 |
| 5,540,406 | A | | 7/1996 | Occhipinti | 244/200 |
| 5,624,234 | A | | 4/1997 | Neely | 416/238 |
| 5,809,800 | A | | 9/1998 | Deal | 62/507 |
| 6,023,938 | A | * | 2/2000 | Taras et al. | 62/296 |
| 6,129,528 | A | | 10/2000 | Bradbury | 417/423 |
| 6,185,954 | B1 | | 2/2001 | Smiley | 62/426 |
| 6,450,760 | B1 | * | 9/2002 | Furukawa et al. | 415/119 |
| 6,626,640 | B2 | | 9/2003 | Ivanovic | 415/142 |
| 2002/0015640 | A1 | * | 2/2002 | Nishiyama et al. | 415/119 |
| 2003/0098144 | A1 | | 5/2003 | Uselton et al. | |

OTHER PUBLICATIONS

Kernstock, Slashing Through the Noise Barrier, *Defense Daily Network—Rotor & Wing's Cover Story*, Aug. 1999, p. 1-11.

* cited by examiner

FIG. 7
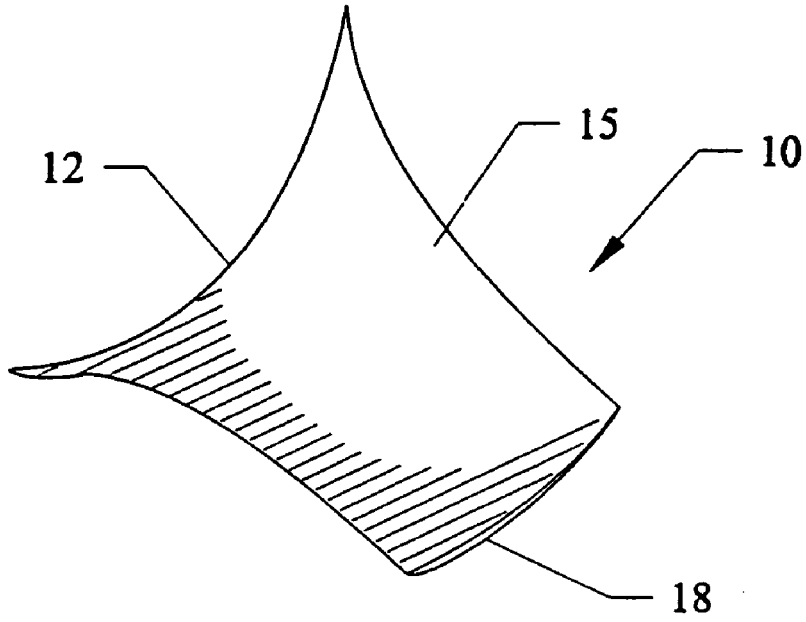
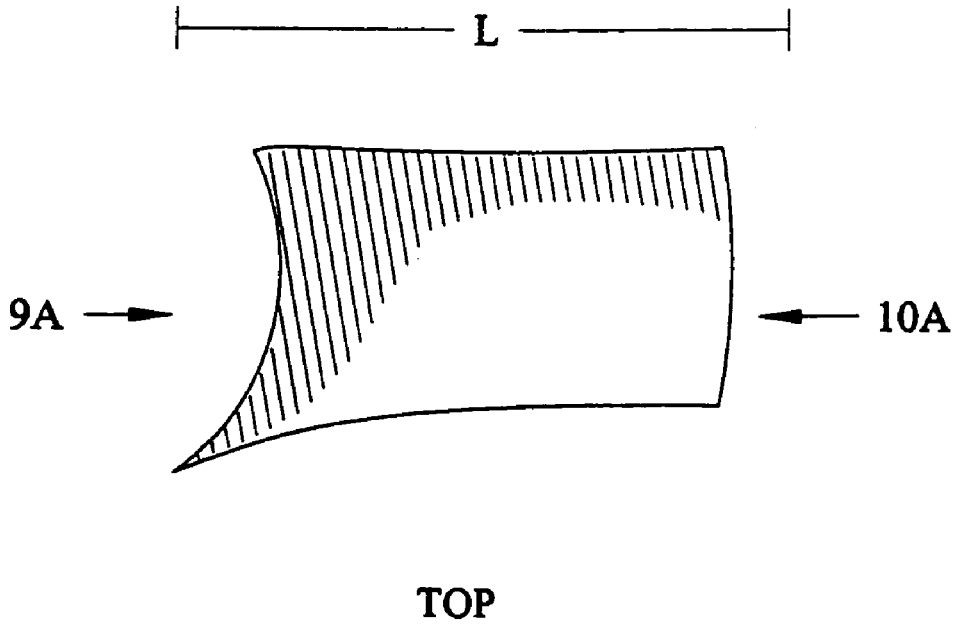
FIG. 8

TOP

BOTTOM (1)
START
1340

1370
(7)
(2)
Read Inlet
Temperature
°F
1345
(3)
Temp
> Hi
°F
Y
Set Fan
Speed High
1350
N
1355
(4)
Temp
< V. Low
°F
Y
Set Fan
Speed V. Low
N
1360
(5)
Temp
< Low
Y
Set Fan
Speed Low
(6)
N
1365
Set Fan
Speed
Medium Fig. 37
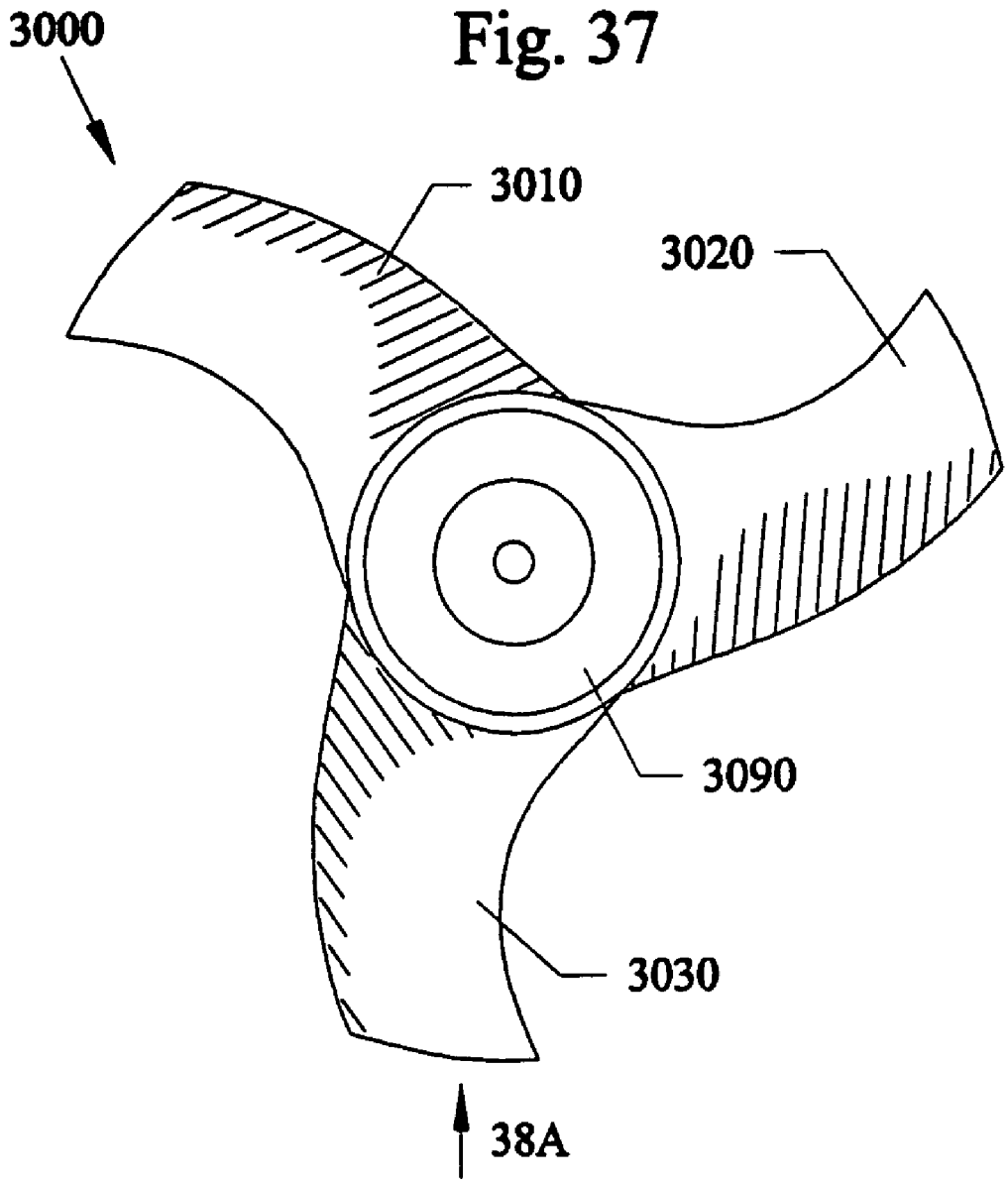
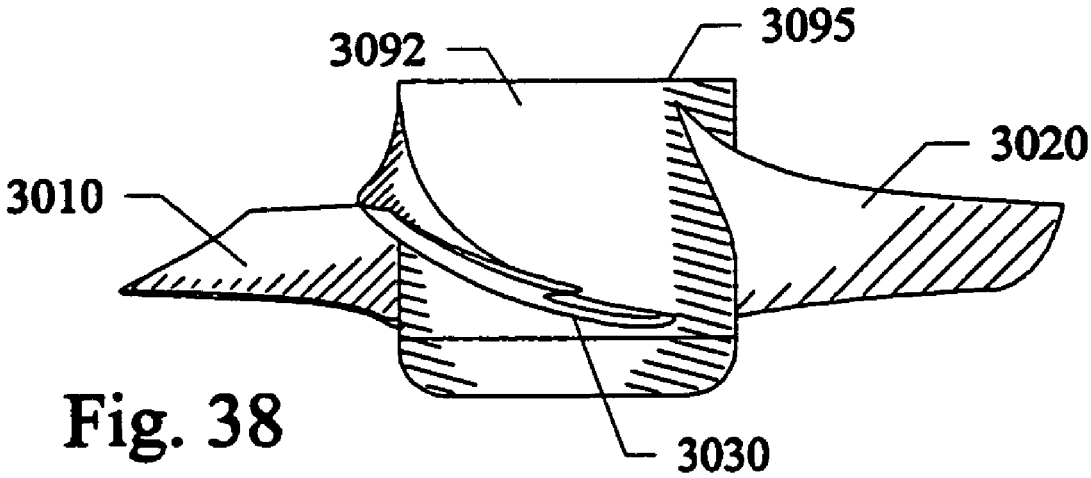
Fig. 38

HIGH EFFICIENCY AIR CONDITIONER CONDENSER FAN WITH PERFORMANCE ENHANCEMENTS

This invention is a Continuation-In-Part of U.S. application Ser. No. 10/400,888 filed Mar. 27, 2003 now U.S. Pat. No. 7,014,423, which claims the benefit of priority to U.S. Provisional Applications 60/369,050 filed Mar. 30, 2002, and 60/438,035 filed Jan. 3, 2003.

FIELD OF INVENTION

This invention relates to air conditioning systems, and in particular to enhancing performance of outdoor air conditioner condenser fans and heat pump assemblies by using twisted shaped blades with optimized air foils for improving air flow and minimizing motor power with and without additional performance enhancement improvements to augment air flow and air efficiency and/or reduce undesirable sound noise levels.

BACKGROUND AND PRIOR ART

Central air conditioning (AC) systems typically rely on using utilitarian stamped metal fan blade designs for use with the outdoor air conditioning condenser in a very large and growing marketplace. In 1997 alone approximately five million central air conditioning units were sold in the United States, with each unit costing between approximately $2,000 to approximately $6,000 for a total cost of approximately $15,000,000,000 (fifteen billion dollars). Conventional condenser fan blades typically have an air moving efficiency of approximately 25%. For conventional three-ton air conditioners, the outdoor fan motor power with conventional type permanent split capacitor (PSC) motors is typically 200-250 Watts which produces approximately 2000-3000 cfm of air flow at an approximately 0.1 to 0.2 inch water column (IWC) head pressure across the fan. The conventional fan system requires unnecessarily large amounts of power to achieve any substantial improvements in air flow and distribution efficiency. Other problems also exist with conventional condensers include noisy operation with the conventional fan blade designs that can disturb home owners and neighbors.

Air-cooled condensers, as commonly used in residential air conditioning and heat pump systems, employ finned-tube construction to transfer heat from the refrigerant to the outdoor air. As hot, high pressure refrigerant passes through the coil, heat in the compressed refrigerant is transferred through the tubes to the attached fins. Electrically powered fans are then used to draw large quantities of outside air across the finned heat transfer surfaces to remove heat from the refrigerant so that it will be condensed and partially sub-cooled prior to its reaching the expansion valve.

Conventional AC condenser blades under the prior art are shown in FIGS. 1-3, which can include metal planar shaped blades 2, 4, 6 fastened by rivets, solder, welds, screws, and the like, to arms 3, 5, and 7 of a central condenser base portion 8, where the individual planar blades (4 for example) can be entirely angle oriented.

The outside air conditioner fan is one energy consuming component of a residential air conditioning system. The largest energy use of the air conditioner is the compressor. Intensive research efforts has examined improvements to it performance. However, little effort has examined potential improvements to the system fans. These include both the indoor unit fan and that of the outdoor condenser unit.

Heat transfer to the outdoors with conventional fans is adequate, but power requirements are unnecessarily high. An air conditioner outdoor fan draws a large quantity of air at a very low static pressure of approximately 0.05 to 0.2 inches of water column (IWC) through the condenser coil surfaces and fins. A typical 3-ton air conditioner with a seasonal energy efficiency ratio (SEER) of 10 Btu/W moves about 2400 cfm of air using about 250 Watts of motor power. The conventional outdoor fan and motors combination is a axial propeller type fan with a fan efficiency of approximately 20% to approximately 25% and a permanent split capacitor motor with a motor efficiency of approximately 50% to approximately 60%, where motor efficiency is the input energy which the motor converts to useful shaft torque, and where fan efficiency is the percentage of shaft torque which the fan converts to air movement.

In conventional systems, a ⅛ hp motor would be used for a three ton air conditioner (approximately 94 W of shaft power). The combined electrical air "pumping efficiency" is only approximately 10 to approximately 15%. Lower condenser fan electrical use is now available in higher efficiency AC units. Some of these now use electronically commutated motors (ECMs) and larger propellers. These have the capacity to improve the overall air moving efficiency, but by about 20% at high speed or less. Although more efficient ECM motors are available, these are quite expensive. For instance a standard ⅛ hp permanent split capacitor (PSC) condenser fan motor can cost approximately $25 wholesale whereas a similar more efficient ECM motor might cost approximately $135. Thus, from the above there exists the need for improvements to be made to the outdoor unit propeller design as well as for a reduction to the external static pressure resistance of the fan coil unit which can have large impacts on potential air moving efficiency. Consumers also express a strong preference for quieter outdoor air conditioning equipment. Currently fan noise from the outdoor air conditioning equipment is a large part of the undesirable sound produced.

Over the past several years, a number of studies have examined various aspects of air conditioner condenser performance, but little examining specific improvements to the outdoor fan unit. One study identified using larger condenser fans as potentially improving the air moving efficiency by a few percent. See J. Proctor, and D. Parker (2001). "Hidden Power Drains: Trends in Residential Heating and Cooling Fan Watt Power Demand," *Proceedings of the* 2000 *Summer Study on Energy Efficiency in Buildings*, Vol. 1, p. 225, ACEEE, Washington, D.C. This study also identified the need to look into more efficient fan blade designs, although did not undertake that work. Thus, there is an identified need to examine improved fan blades for outdoor air conditioning units.

Currently, major air conditioner manufacturers are involved in efforts to eliminate every watt from conventional air conditioners in an attempt to increase cooling system efficiency in the most cost effective manner. The prime pieces of energy using equipment in air conditioners are the compressor and the indoor and outdoor fans.

Conventional fan blades used in most AC condensers are stamped metal blades which are cheap to manufacture, but are not optimized in terms of providing maximum air flow at minimum input motor power. Again, FIGS. 1-3 shows conventional stamped metal condenser fan blades that are typically used with typical outdoor air conditioner condensers such as a 3 ton condenser.

In operation, a typical 3-ton condenser fan from a major U.S. manufacturer draws approximately 195 Watts for a system that draws approximately 3,000 Watts overall at the ARI 95/80/67 test condition. Thus, potentially cutting the outdoor fan energy use by approximately 30% to 50% can improve air conditioner energy efficiency by approximately 2% to 3% and directly cut electric power use.

Residential air conditioners are a major energy using appliance in U.S. households. Moreover, the saturation of households using this equipment has dramatically changed over the last two decades. For instance, in 1978, approximately 56% of U.S. households had air conditioning as opposed to approximately 73% in 1997 (DOE/EIA, 1999). The efficiency of residential air conditioner has large impacts on utility summer peak demand since air conditioning often comprises a large part of system loads.

Various information on typical air conditioner condenser systems can be found in references that include:

DOE/EIA, 1999. *A Look at Residential Energy Consumption in* 1997, Energy Information Administration, DOE/EIA-0632 (97), Washington, D.C.

J. Proctor and D. Parker (2001). "Hidden Power Drains: Trends in Residential Heating and Cooling Fan Watt Power Demand," *Proceedings of the* 2000 *Summer Study on Energy Efficiency in Buildings*, Vol. 1, p. 225, ACEEE, Washington, D.C.

J. Proctor, Z. Katsnelson, G. Peterson and A. Edminster, *Investigation of Peak Electric Load Impacts of High SEER Residential HVAC Units*, Pacific Gas and Electric Company, San Francisco, Calif., September, 1994.

Many patents have been proposed over the years for using fan blades but fail to deal with specific issues for making the air conditioner condenser fans more efficient for flow over the typical motor rotational speeds. See U.S. Pat. No. 4,526,506 to Kroger et al.; U.S. Pat. No. 4,971,520 to Houten; U.S. Pat. No. 5,320,493 to Shih et al.; U.S. Pat. No. 6,129,528 to Bradbury et al.; and U.S. Pat. No. 5,624,234 to Neely et al.

Although the radial blades in Kroger '506 have an airfoil, they are backward curved blades mounted on an impeller, typically used with a centrifugal fan design typically to work against higher external static pressures. This is very different from the more conventional axial propeller design in the intended invention which operates against very low external static pressure (0.05-0.2 inches water column—IWC).

Referring to Houten '520, their axial fan describes twist and taper to the blades, and incorporates a plurality of blades attached to an impeller, rather than a standard hub based propeller design. This impeller is not optimal for standard outdoor air conditioning systems as it assumes its performance will be best when it is heavily loaded and is located very close to the heat exchanger (as noted in "Structure and Operation", Section 50). In a standard residential outdoor air conditioner, the fan is located considerably above the heat exchange surfaces and the fan operates in a low-load condition under low external static pressure. This distinction is clear in FIG. 1 of the Houten apparatus where it is intended that the fan operate immediately in front of the heat exchange surface as with an automobile air conditioning condenser (see *High Efficiency Fan,* 1*, last paragraph*). The blades also do not feature a true air foil with a sharp trailing edge shown in FIG. 4A-4B.

Referring to Shih et al. '493, the axial fan describes features twisted blades, but are designed for lower air flow and a lower as would be necessary for quietly cooling of office automation systems. Such a design would not be appropriate for application for air condition condenser fan where much large volumes of air (e.g. 2500 cfm) must be moved at fan rotational velocities of 825-1100 rpm. The low air flow parameters and small air flow produced are clearly indicated in their "Detailed Description of the Invention." The en1Kspeed a considerably different design for optimal air moving performance.

Referring to Bradbury '528, that device encompasses an axial fan designed to effectively cool electronic components in a quiet manner. The fans feature effective air foils, but the specific blade shape, chord, taper and twist are not optimized for the specific requirements for residential air conditioning condensers (825-1100 rpm with 2000-4800 cfm of air flow against low static pressures of 0.10-0.15 IWC) Thus, the cross sectional shapes and general design of this device are not relevant to the requirements for effective fans for air conditioner condensers. The limitations of Bradbury are clearly outlined in Section 7, 40 where the applicable flow rates are only 225 to 255 cfm and the rotational rates are 3200 to 3600 rpm. By contrast, the residential air conditioner condenser fans in the proposed invention can produce approximately 2500 to approximately 4500 cfm at rotational velocities of approximately 825 to approximately 1100 rpm The Neely '234 patented device consists of an axial fan designed for vehicle engine cooling. Although its blades include a twisted design and airfoil mounted on a ring impeller, it does not feature other primary features which distinguished the proposed invention. These are a tapered propeller design optimized for an 825-1100 RPM fan speed and for moving large quantities of air (2000-2500 cfm) at low external static pressure. As with the prior art by Houten, the main use for this invention would be for radiator of other similar cooling with an immediately adjacent heat exchanger. The Neely device is optimized for higher rotational speeds (1900-2000 rpm) which would be too noisy for outdoor air conditioner condenser fan application (see Table 1). It also does not achieve sufficient flow as the Neely device produces a flow of 24.6-25.7 cubic meters per minute or 868 to 907 cfm—only half of the required flow for a typical residential air conditioner condenser (Table 1). Thus, the Neely device would not be use relevant for condenser fan designs which need optimization of the blade characteristics (taper, twist and airfoil) for the flow (approximately 2500 to approximately 4500 cfm) and rotational requirements of approximately 825 to approximately 1100 rpm.

The prior art air conditioning condenser systems and condenser blades do not consistently provide for saving energy at all times nor sound reduction when the air conditioning system operates and do not provide dependable electric load reduction under peak conditions.

Thus, improved efficiency of air conditioning condenser systems would be both desirable for consumers as well as for electric utilities.

For air conditioning manufacturers, reducing the sound produced by outdoor units is at least as large an objective as reducing unit energy consumption. In a detailed survey of 550 homeowners, researchers found that increases in the ambient background sound levels of 5 dB or more were associated with dramatic increases in the number of complaints about air conditioner noise levels. Similarly, the same study indicated that surveyed people would be willing to pay up to 12% more to purchase a very quiet air conditioner. See: J. S. Bradley, "Noise from Air Conditioners," Acoustics Laboratory, Institute for Research and Construction, National Research Council of Canada, Ottawa, Ontario, 1993.

Thus, achieving very low sound levels in outdoor air conditioning units and heat pump assemblies is a very important objective for air conditioning condenser fan system manufacturers.

Thus, the need exists for solutions to the above problems in the prior art.

SUMMARY OF THE INVENTION

A primary objective of the invention is to provide condenser fan blades for air conditioner condenser or heat pump systems and methods of use that saves energy at all times when the air conditioning system operates, provides dependable electric load reduction under peak conditions, and operates more quietly than standard air conditioners.

A secondary objective of the invention is to provide condenser fan blades for air conditioner condenser or heat pump systems and methods of use that would be both desirable for both consumers as well as for electric utilities.

A third objective of the invention is to provide air conditioner condenser blades and methods of use that increase air flow and energy efficiencies over conventional blades.

A fourth objective of the invention is to provide air conditioner condenser blades for air conditioning systems or heat pumps that can be made from molded plastic, and the like, rather than stamped metal.

A fifth objective of the invention is to provide systems and methods for operating air conditioner condenser or heat pump fan blades at approximately 825 rpm to produce airflow of approximately 2000 cfm using approximately 110 Watts of power.

A sixth objective of the invention is to provide a condenser or heat pump fan blade and methods of use that improves air flow air moving efficiencies by approximately 30% or more over conventional blades.

A seventh objective of the invention is to provide a condenser or heat pump fan blade and methods of use that uses less power than conventional condenser motors.

An eighth objective of the invention is to provide a condenser or heat pump fan blade and diffuser assembly and methods of use that allows for more quiet outdoor operation than conventional condenser or heat pump fans.

A ninth objective of the invention is to provide a condenser fan blade or heat pump assembly and methods of use which aids heat transfer to the air conditioner condenser that rejects heat to the outdoors.

A tenth objective of the invention is to provide a condenser or heat pump fan blade assembly and method of use that provides demonstrable improvements to space cooling efficiency.

An eleventh objective of the invention is to provide a condenser or heat pump fan assembly and method of use that has measurable electric load reduction impacts on AC system performance under peak demand conditions.

A twelfth objective of the invention is two diffuser design configurations to reduce pressure rise on the condenser fan and velocity pressure recovery to further improve air moving performance. Tests showed short conical exhaust diffuser can improve air moving efficiency by a further approximately 21% (approximately 400 cfm) over a conventional "starburst" or coil wire type exhaust grill.

A thirteenth objective is to provide air conditioner condenser fan blades having an asymmetrical configuration and methods of use to achieve lower sound levels due to its altered frequency resonance, thus having reduced noise effects over conventional configurations.

A fourteenth objective of the present invention is to provide the exhaust diffuser interior walls with members and method of use which safely reduces fan blade tip clearance improving air moving performance while breaking up fan vortex shedding which is largely responsible for high fan noise.

A fifteenth objective of the invention is to provide for methods and systems and components that achieve very low sound levels in outdoor air conditioning units having condenser fan systems.

Embodiments for the invention include an approximately 19 inch tip to tip condenser fan blade system, and an approximately 27 inch tip to tip condenser fan blade system. The higher efficiency fan produces a fan blade shape that will fit in conventional AC condensers (approximately 19 inches wide for a standard three-ton condenser and approximately 27 inches wide for a higher efficiency model) with the improved diffuser sections. The tested 19 inch fan provides an airflow of approximately 850 rpm to produce approximately 1930 cfm of air flow at up to approximately 140 Watts using a 8-pole motor.

Using an OEM 6-pole ⅛ hp motor produced approximately 2610 cfm with approximately 145 Watts of power while running the blades at approximately 1100 rpm.

Asymmetrical air conditioner condenser fan blades are also described that can reduce noise effects over conventional air conditioner condenser or heat pump fan blades by allowing lower RPM (revolutions per minute) operation and reduction of blade frequency resonance. A preferred embodiment shows at least an approximate 1 dB reduction using a five blade asymmetrical configuration.

Novel diffuser housing configurations can include a conical housing, a conical center body to aid air flow, and rounded surfaces for reducing backpressure problems over the prior art.

A porous surface liner, such as a foam strip can be provided on the interior facing walls of the diffuser housing to reduce vortex shedding and the associated noise produced therefrom. An open cell foam liner can be used having the extra double advantage of reducing fan tip clearance and greatly improving air flow performance from the condenser fan. A porous edge, such as a foam strip can also be used on either or both the trailing edge or the tip edge of the rotating blades. The porous edge can be used with or without the surface liner to reduce undesirable sound noise emissions as well as increase air flow performance of the rotating blades.

Further objects and advantages of this invention will be apparent from the following detailed description of the presently preferred embodiments which are illustrated schematically in the accompanying drawings.

BRIEF DESCRIPTION OF THE FIGURES

FIG. 7 is a perspective view of a single twisted condenser blade for the assembly of FIGS. 1-3 for a single blade used in the 19" blade assemblies.

FIG. 8 is a top view of a single novel condenser blade of FIG. 7.

FIG. 37 is a bottom perspective view of still another preferred embodiment of a three condenser blade assembly of the invention.

FIG. 38 is a side view of the three blade assembly of FIG. 37 along arrow 38A.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

Figure 1:
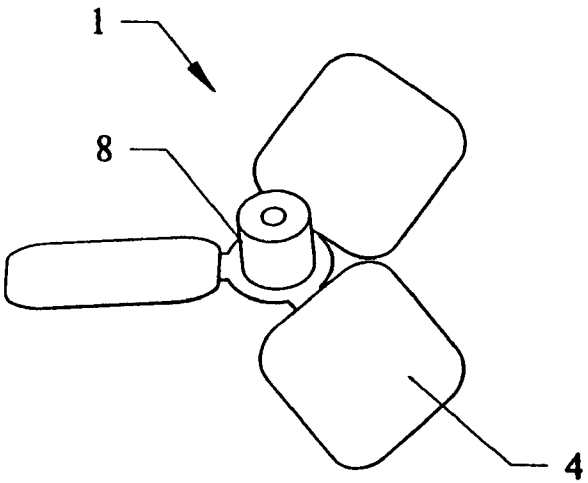
FIG. 1 (PRIOR ART)
FIG. 1 is a perspective view of a prior condenser blade assembly.
Figure 2:
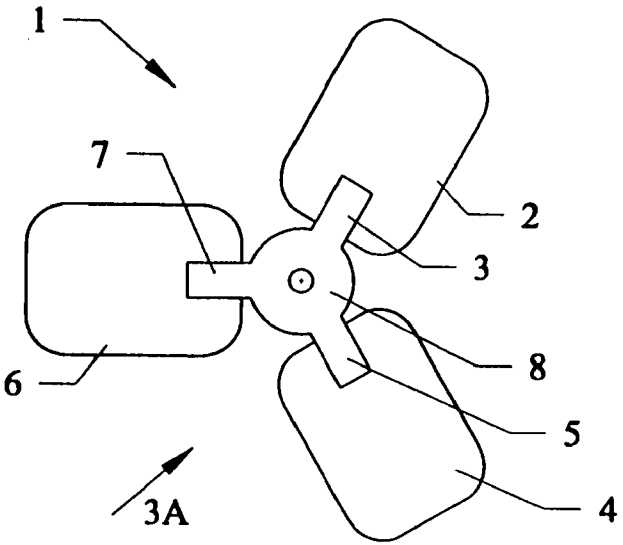
FIG. 2 (PRIOR ART)
FIG. 2 is a top view of the prior art condenser blade assembly of FIG. 1.
Figure 3:
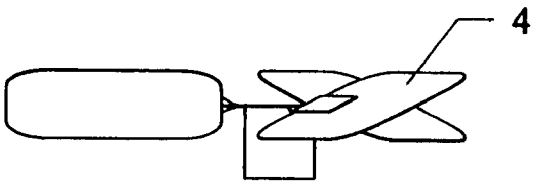
FIG. 3 (PRIOR ART)
FIG. 3 is a side view of the prior art condenser blade assembly of FIG. 2 along arrow 3A.

Unlike the flat planar stamped metal blades that are prevalent in the prior art as shown in FIGS. 1-3, the subject invention can have molded blades that can be twisted such as those formed from molded plastic, and the like.

Novel fan blades attached to a condenser hub can rotate at approximately 840 rpm producing approximately 2200 cfm of air flow and 2800 cfm at 1100 rpm.

The standard stamped metal blades in as shown in the prior art of FIGS. 1-3 can produce approximately 2200 cfm with approximately 190 Watts of power at approximately 1050 rpm.

The improved fan of the invention with the improved diffuser and with exactly the same OEM 6-pole ⅛ hp PSC motor produced approximately 2610 cfm with approximately 195 Watts of power at approximately 1100 rpm. Direct power savings are approximately 45 Watts (an approximately 24% drop in outdoor unit fan power).

Our tests showed that the novel fan blades with the improved diffuser can also be slowed from approximately 1100 to approximately 850 rpm and still produce approximately 1930 cfm of air flow with only approximately 110 Watts, an approximately 51% reduction in fan power for non-peak conditions. The lower rpm range with an engineered diffuser results in substantially quieter fan operation approximately 14 dB lower sound. Another fan was designed which provides a 40 W power savings than the standard fan, but without the sound reduction advantages.

For a typical 3-ton heat pump, total system power (compressor, indoor and outdoor fans) would typically drop from approximately 3,000 Watts at design condition (95 O.D., 80,67 IDB/IWB) to approximately 2950 Watts with the new fan, an approximately 2% reduction in total cooling power.

For a typical heat pump consumer with approximately 2,000 full load hours per year, this would represent an approximately $10 savings annually. The fabrication of the fan assembly is potentially similar to fabricated metal blades so that the payback could be virtually immediate. Additionally, the condenser fan motor can also be less loaded than with the current configuration improving the motor life and reliability. When coupled with an electrically commutated motor (ECM), the savings are approximately doubled.

When the fan blades are coupled to an ECM motor, the measured savings increase from roughly 45 Watts to approximately 100 Watts with the test apparatus. Not only are saving increased, but it is then possible with the ECM motor to vary continuously the motor speed without sacrificing its efficiency. Within the preferred embodiment of the invention, the fan speed would be low (approximately 750 rpm) when the temperature outdoors was less than a factory preset level (e.g. 90 F). This would provide greatest fan power savings (greater than approximately 110 Watts) as well as very quiet operation during sensitive nighttime hours and other times when occupancy and neighbors are likely to be outdoors. However, when the temperature was above approximately 90 F, the ECM motor could move to a higher speed (e.g. approximately 1000 rpm) where the produced air flow would result in greatest air conditioner efficiency and cooling capacity with fan-only power savings still greater than approximately 80 Watts.

Thus, this control scheme would provide both maximum AC efficiency in the hottest periods as well as most quiet operation at other times which is highly desirable for home owners.

Thus, the invention achieves a significant performance improvement that can be readily adaptable to use within current lines of unitary air conditioners to cut outdoor AC unit fan power by approximately 24% or more over standard condenser fan blade assemblies.

The novel invention embodiments can provide power savings with little change in the cost of the fans and also provide substantially better flow at low speed operation which is something the better motors cannot provide.

Condenser Fan Assemblies with Twisted Blade

Figure 4:
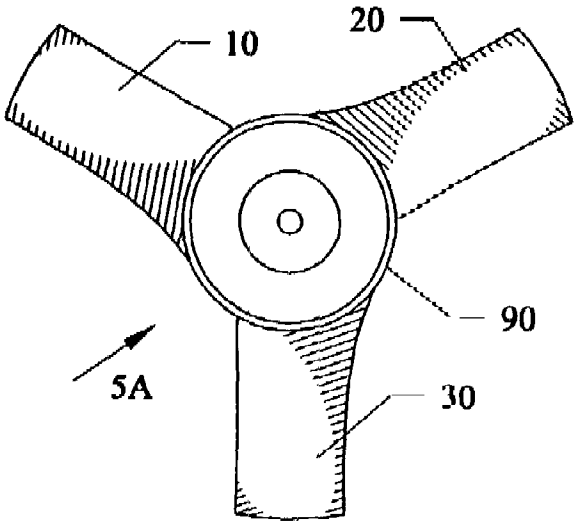
FIG. 4 is a bottom perspective view of a first preferred embodiment of a three condenser blade assembly of the invention.
Figure 5:
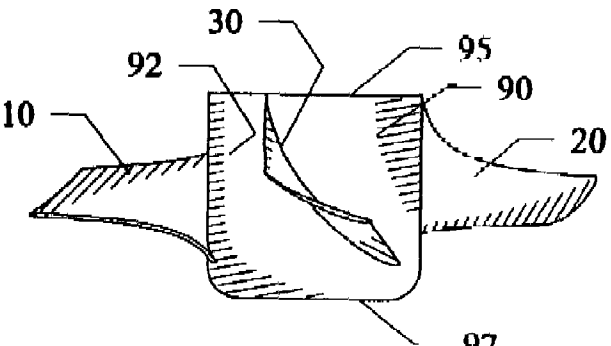
FIG. 5 is a side view of the three blade assembly of FIG. 4 along arrow 5A.
Figure 6:
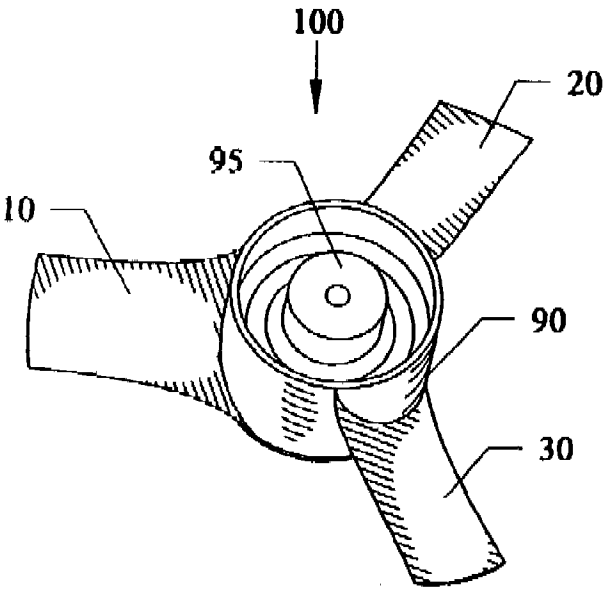
FIG. 6 is a perspective view of the three blade assembly of FIGS. 4-5.

FIG. 4 is a bottom perspective view of a first preferred embodiment of a three condenser blade assembly 100 of the invention. FIG. 5 is a side view of the three blade assembly 100 of FIG. 4 along arrow 5A. FIG. 6 is a perspective view of the three blade assembly 100 of FIGS. 4-5.

Referring to FIGS. 4-6, a central hub 90 can include a bottom end 95 for attaching the assembly 100 to standard or novel condenser housing which will be described later in reference to FIGS. 19-23. The central hub can include a top end and sides 92 on which three novel twisted blades 10, 20, 30 can be mounted in an equally spaced configuration thereon. For example, the blades can be spaced approximately 120 degrees apart from one another. The blades 10, 20, 30 can be separately molded and later fastened to the hub 90 by conventional fasteners as described in the prior art. Alternatively, both the novel blades 10, 20, 30 and hub 90 can be molded together into the three blade assembly 100.

Table 1 shows the comparative performance of the novel condenser fan 19" blades AC-A@, AC-B@, and 27.6" blades AC-5@, and AC-D and AC-E blades compared to standard 19" and 27.6" condenser fans. All fans were tested for flow with an experimental set up in accordance with ASHRAE ANSI Standard 51-1985 "Laboratory Methods of Testing Fans for Ratings." A setup was used with an outlet chamber setup with the calibrated nozzle on one end of the chamber. Power was measured with a calibrated watt hour meter with a resolution of 0.2 Watts. Condenser sound levels were measured for the fan only in accordance with ARI Standard 270-1995 using a precision sound meter with A-weighting.

TABLE 1

Comparative Performance of Air Conditioner Fans
Against Conventional Models
(External Fan Static Pressure = ~0.15 IWC; Fan motor efficiency = 60%)

HIGH SPEED

| | Small Std. | Novel AC-A@ | Novel AC-B@ | Std. Large | Novel AC A5@[2] | Novel AC-D | Novel AC-E |
|---|---|---|---|---|---|---|---|
| Size | 19" | 19" | 19" | 27.6" | 27.6" | 19" | 19" |
| HP | ⅛ hp | ⅛ hp | ⅛ hp | ⅛ hp | ⅛ hp | ⅛ hp | ⅛ hp |
| RPM | 1,050 | 1,110 | 1,130 | 820 | 860 | 1,100 | 1,100 |
| CFM | 2,180 | 2,610 | 2,380 | 4,500 | 4,500 | 2,570 | 2,500 |
| Watts | 193 | 145 | 140 | 250 | 170 | 151 | 132 |
| CFM-W | 11.3 | 18.0 | 17.0 | 18.0 | 26.5 | 17.0 | 18.9 |
| $DB_1$ | 62.5 | 66.0 | 65.0 | 61.0 | na | 66.0 | 64.5 |

LOW SPEED

| | Novel AC-A@ | Novel AC-B@ | Novel AC-A5@[3] | Novel AC-D | Novel AC-E |
|---|---|---|---|---|---|
| Size | 19" | 19" | 19" | 19" | 19" |
| HP | ⅛ hp | ⅛ hp | ⅛ hp | ⅛ hp | ⅛ hp |
| RPM | 870 | 870 | 750 | 870 | 870 |
| CFM | 1,930 | 1,825 | 2,300 | 1,940 | 1,825 |
| Watts | 111 | 115 | 141 | 114 | 109 |

TABLE 1-continued

| Comparative Performance of Air Conditioner Fans Against Conventional Models (External Fan Static Pressure = ~0.15 IWC; Fan motor efficiency = 60%) | | | | | |
|---|---|---|---|---|---|
| CFM-W | 17.4 | 20.1 | 16.3 | 17.0 | 16.7 |
| dB | 58.5 | 58.0 | 60.0 | 60.0 | 61.0 |

* uses low pressure rise diffuser
(1) Calibrated sound pressure measurement according to ARI Standard 270-1995, AC@ weighting; condenser fan only
(2) Simulated performance, shaft power is 72 W against a condenser housing pressure rise of 33 Pa
(3) 5-bladed asymmetrical design
High Speed uses a six pole motor and corresponds to a speed of 1050-1100 RPM.
Low Speed corresponds to a speed of 830-870 RPM.
HP is horsepower
RPM is revolutions per minute
CFM is cubic feet per minute
Watts is power
CFM/W is cubic feet per minute per watts
dB is decibels(dBA) of sound pressure measured over a one minute period tested according to ARI Standard 270-1995

Fan AC-A and AC-B differ in their specific fan geometry. Fan B is designed for a higher pressure rise than Fan AC-A. Fan AC-B exhibits better performance with conventional condenser exhaust tops. Fan AC-A, which is designed for lower pressure rise, showed that it may perform better when coupled to a conical diffuser exhaust.

Fan "AC-A5@" is a five-bladed asymmetrical version of the Fan A blades, designed to lower ambient sound levels through lower rpm operation and reduced blade frequency resonance.

Figure 10:
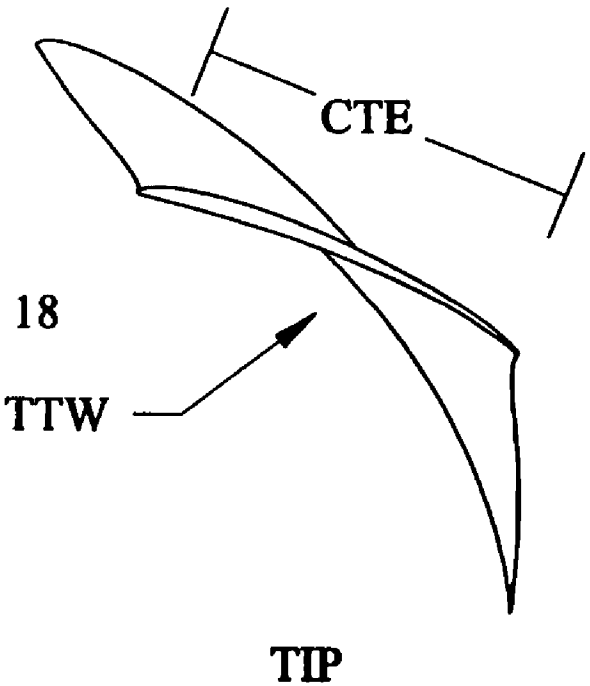
FIG. 10 is a tip end view of the single blade of FIG. 8 along arrow 10A.
Figure 9:
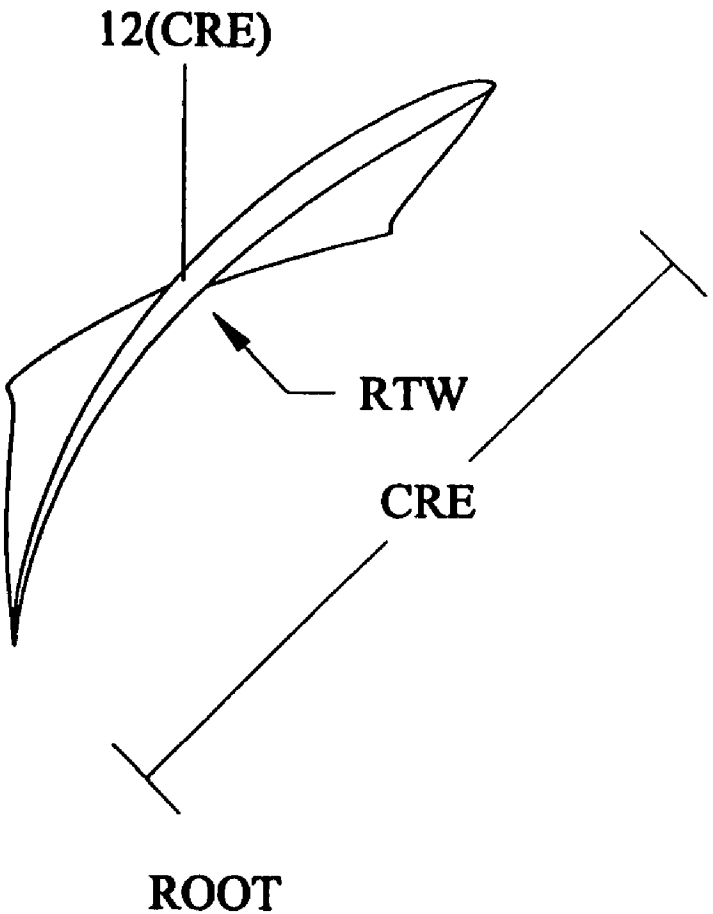
FIG. 9 is a root end view of the single blade of FIG. 8 along arrow 9A.

FIG. 7 is a perspective view of a single twisted condenser blade 10 for the assembly 100 of FIGS. 1-3 for a single blade used in the 19" blade assemblies. FIG. 8 is a top view of a single novel condenser blade 10 of FIG. 7. FIG. 9 is a root end view 12 of the single blade 10 of FIG. 8 along arrow 9A. FIG. 10 is a tip end view 18 of the single blade 10 of FIG. 8 along arrow 10A. Referring to FIGS. 7-10, single twisted blade 10 has a root end 12(CRE) that can be attached to the hub 90 of the preceding figures, a twisted main body portion 15, and an outer tip end (TE) 18. L refers to the length of the blade 10, RTW refers to root end twist angle in degrees, and TTW refers to the tip twist angle in degrees.

TABLE 2 shows single blades dimensions for each of the novel blade assemblies, AC-A@, AC-B@, AC-A5@, AC-D and AC-E

| Title | Length L Inches | Root Twist RTW degrees | Tip Twist TTW degrees | Root Edge CRE inches | Tip Edge CTE inches |
|---|---|---|---|---|---|
| AC-A@ | 6.25" | 44.9° | 20° | 7.90" | 3.875" |
| AC-B@ | 6.25" | 29.9 | 19.9° | 6.75" | 3.625" |
| AC-A5@ | 6.25" | 44.9° | 20° | 7.90" | 3.875" |
| AC-D | 6.25" | 34.7° | 20.6° | 7.25" | 3.667" |
| AC-E | 6.25" | 30.9° | 21.6° | 8.0" | 4.041" |

Each of the blades AC-A@, AC-B@, and AC-A5@ are attached at their root ends to the hub at a greater pitch than the outer tip ends of the blade. For example, the angle of pitch is oriented in the direction of attack (rotation direction) of the blades. Each blade has a width that can taper downward from a greater width at the blade root end to a narrower width at the blade tip end.

Each blade AC-A@, AC-B@, and AC-C@ has a wide root end CRE, with an upwardly facing concaved rounded surface with a large twist on the blade. Along the length of each blade the twist straightens out while the blade width tapers to a narrower width tip end CTE having a smaller blade twist. The tip end CTE can have an upwardly facing concaved triangular surface.

Figure 11:
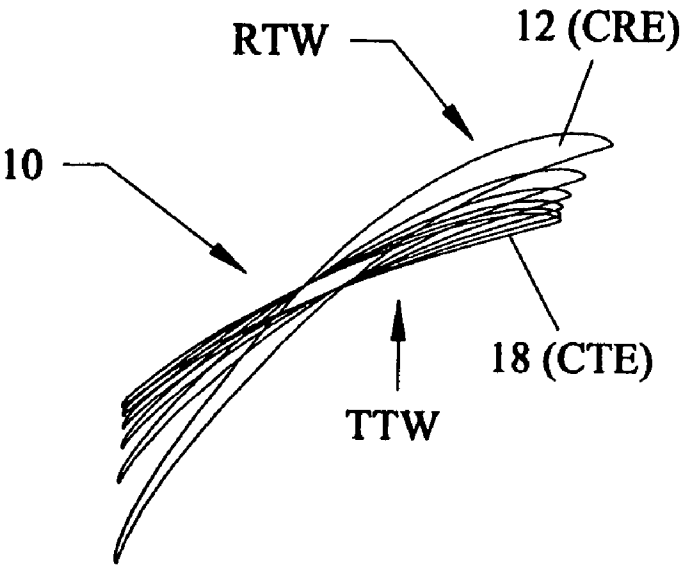
FIG. 11 shows a single condenser blade of FIGS. 7-10 represented by cross-sections showing degrees of twist from the root end to the tip end.

FIG. 11 shows a single condenser blade 10 of FIGS. 7-10 represented by cross-sections showing degrees of twist from the root end RTW and 12 (CRE) to the tip end TTW and 18 (CTE).

Figure 12:
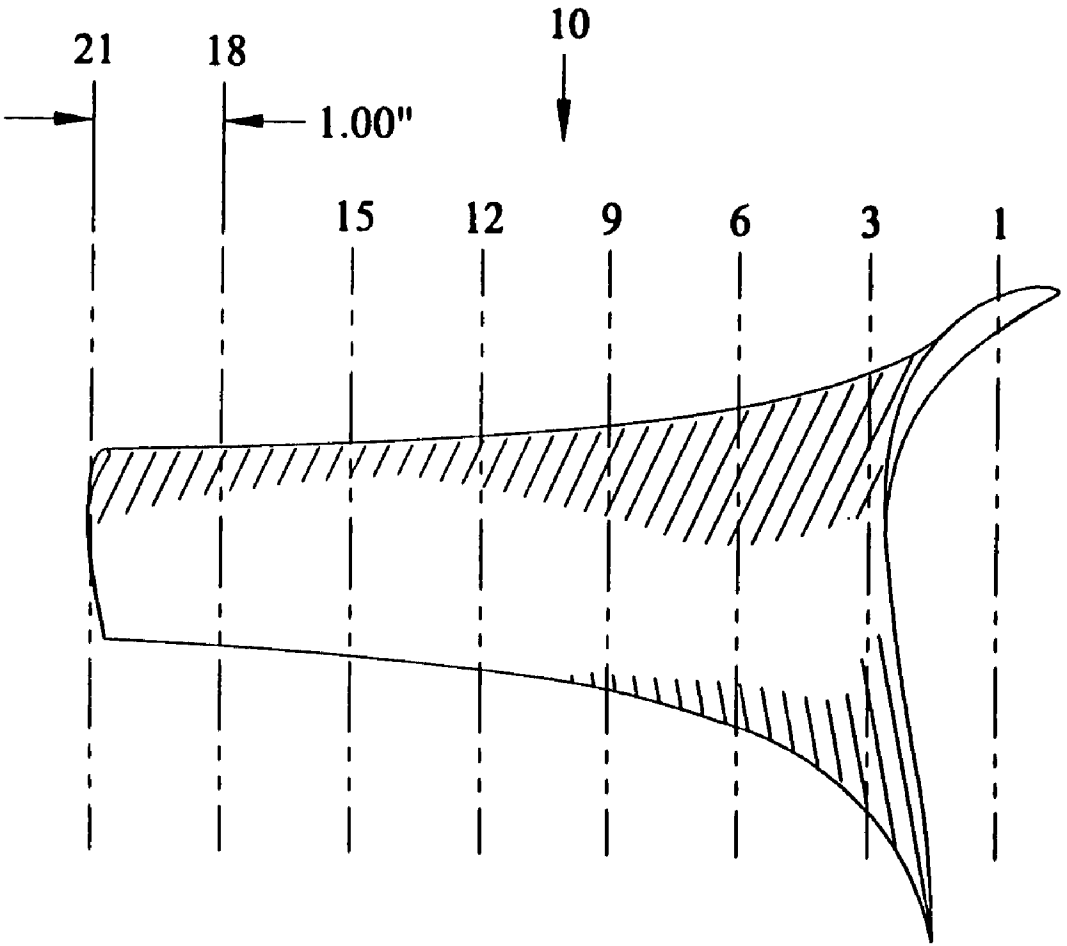
FIG. 12 shows an enlarged side view of the blade of FIG. 10 with section lines spaced approximately 1 inch apart from one another.

FIG. 12 shows an enlarged side view of the blade of FIG. 10 with seven section lines spaced equally apart from one another. Only seven are shown for clarity.

Table 3 shows a blade platform definition along twenty one (21) different station points along the novel small blade AC-A@, and AC-B@ used in the 19" blade assemblies.

TABLE 3

Blade platform definition

| Station | Radius Meters | Chord Meters | Twist Degrees |
|---|---|---|---|
| 1 | 0.0857 | 0.1774 | 47.07 |
| 2 | 0.0935 | 0.1473 | 42.16 |
| 3 | 0.1013 | 0.1326 | 39.15 |
| 4 | 0.1091 | 0.1232 | 36.92 |
| 5 | 0.1168 | 0.1167 | 35.13 |
| 6 | 0.1246 | 0.1118 | 33.63 |
| 7 | 0.1324 | 0.1080 | 32.35 |
| 8 | 0.1402 | 0.1050 | 31.23 |
| 9 | 0.1480 | 0.1027 | 30.23 |
| 10 | 0.1557 | 0.1008 | 29.34 |
| 11 | 0.1635 | 0.0993 | 28.53 |
| 12 | 0.1713 | 0.0980 | 27.79 |
| 13 | 0.1791 | 0.0971 | 27.11 |
| 14 | 0.1868 | 0.0963 | 26.48 |
| 15 | 0.1946 | 0.0957 | 25.90 |
| 16 | 0.2024 | 0.0953 | 25.36 |
| 17 | 0.2102 | 0.0950 | 24.85 |
| 18 | 0.2180 | 0.0948 | 24.37 |
| 19 | 0.2257 | 0.0947 | 23.92 |
| 20 | 0.2335 | 0.0948 | 23.50 |
| 21 | 0.2413 | 0.0949 | 23.10 |

Table 3 summarizes the condenser fan blade geometrics. Since Fan AC-A5@ uses the same fan blade as "AC-A@" (but is a 5-blade version) its description is identical. Slicing the novel 19 inch blade into 21 sections from the root end to the tip end would include X/C and Y/C coordinates.

The following Table 3RP shows the coordinate columns represent the X/C and Y/C coordinates for the root end station portion (where the blades meet the hub) of the novel twisted blades for a 19 inch fan size. These coordinates are given in a non-dimensional format, were x refers to the horizontal position, y refers to the vertical position and c is the chord length between the stations.

TABLE 3

| RP-X/C and Y/C coordinates for Root End Station Airfoil coordinates at station 1 | |
|---|---|
| X/C | Y/C |
| 1.00000 | 0.00000 |
| 0.99906 | 0.00187 |
| 0.99622 | 0.00515 |
| 0.99141 | 0.00984 |
| 0.98465 | 0.01536 |
| 0.97598 | 0.02187 |
| 0.96542 | 0.02904 |
| 0.95302 | 0.03690 |
| 0.93883 | 0.04522 |
| 0.92291 | 0.05397 |
| 0.90532 | 0.06297 |
| 0.88612 | 0.07216 |
| 0.86540 | 0.08139 |
| 0.84323 | 0.09058 |
| 0.81970 | 0.09960 |
| 0.79490 | 0.10837 |
| 0.76893 | 0.11677 |
| 0.74188 | 0.12471 |
| 0.71386 | 0.13208 |
| 0.68498 | 0.13881 |
| 0.65535 | 0.14480 |
| 0.62508 | 0.15000 |
| 0.59429 | 0.15433 |
| 0.56310 | 0.15775 |
| 0.53162 | 0.16022 |
| 0.50000 | 0.16170 |
| 0.46835 | 0.16218 |
| 0.43679 | 0.16164 |
| 0.40545 | 0.16009 |
| 0.37447 | 0.15755 |
| 0.34396 | 0.15402 |
| 0.31406 | 0.14957 |
| 0.28489 | 0.14421 |
| 0.25656 | 0.13807 |
| 0.22921 | 0.13116 |
| 0.20293 | 0.12358 |
| 0.17786 | 0.11541 |
| 0.15409 | 0.10671 |
| 0.13173 | 0.09755 |
| 0.11089 | 0.08807 |
| 0.09165 | 0.07833 |
| 0.07408 | 0.06855 |
| 0.05826 | 0.05878 |
| 0.04424 | 0.04927 |
| 0.03207 | 0.04004 |
| 0.02182 | 0.03133 |
| 0.01351 | 0.02308 |
| 0.00718 | 0.01570 |
| 0.00282 | 0.00910 |
| 0.00043 | 0.00394 |
| 0.00000 | 0.00000 |
| 0.00155 | −0.00061 |
| 0.00507 | −0.00014 |
| 0.01054 | 0.00175 |
| 0.01790 | 0.00459 |
| 0.02713 | 0.00854 |
| 0.03815 | 0.01333 |
| 0.05094 | 0.01897 |
| 0.06544 | 0.02521 |
| 0.08159 | 0.03203 |
| 0.09934 | 0.03927 |
| 0.11860 | 0.04689 |
| 0.13930 | 0.05475 |
| 0.16136 | 0.06278 |
| 0.18472 | 0.07082 |

TABLE 3-continued

| RP-X/C and Y/C coordinates for Root End Station Airfoil coordinates at station 1 | |
|---|---|
| X/C | Y/C |
| 0.20928 | 0.07877 |
| 0.23497 | 0.08647 |
| 0.26168 | 0.09379 |
| 0.28933 | 0.10065 |
| 0.31782 | 0.10693 |
| 0.34702 | 0.11256 |
| 0.37684 | 0.11747 |
| 0.40717 | 0.12159 |
| 0.43788 | 0.12486 |
| 0.46886 | 0.12722 |
| 0.50000 | 0.12864 |
| 0.53117 | 0.12909 |
| 0.56224 | 0.12857 |
| 0.59309 | 0.12709 |
| 0.62361 | 0.12468 |
| 0.65367 | 0.12135 |
| 0.68314 | 0.11717 |
| 0.71192 | 0.11219 |
| 0.73987 | 0.10647 |
| 0.76690 | 0.10009 |
| 0.79289 | 0.09315 |
| 0.81773 | 0.08573 |
| 0.84132 | 0.07795 |
| 0.86357 | 0.06989 |
| 0.88439 | 0.06171 |
| 0.90370 | 0.05349 |
| 0.92142 | 0.04542 |
| 0.93747 | 0.03754 |
| 0.95181 | 0.03007 |
| 0.96436 | 0.02302 |
| 0.97508 | 0.01666 |
| 0.98393 | 0.01094 |
| 0.99088 | 0.00623 |
| 0.99589 | 0.00241 |
| 0.99896 | 0.00006 |
| 1.00000 | −0.00141 |
| 1.00000 | 0.00141 |

The following Table 3PE shows the coordinate columns representing the X/C and Y/C coordinates for the tip end station section of the 21 sections of the novel twisted 19 inch blades for an approximately 850 rpm running blades. These coordinates are given in a non-dimensional format, were x refers to the horizontal position, y refers to the vertical position and c is the chord length between the stations.

TABLE 3

| PE-X/C and Y/C coordinates for Tip End Station Airfoil coordinates at station 21 | |
|---|---|
| X/C | Y/C |
| 1.00000 | 0.00000 |
| 0.99906 | 0.00122 |
| 0.99622 | 0.00330 |
| 0.99141 | 0.00601 |
| 0.98465 | 0.00904 |
| 0.97598 | 0.01243 |
| 0.96542 | 0.01603 |
| 0.95302 | 0.01985 |
| 0.93883 | 0.02376 |
| 0.92291 | 0.02779 |
| 0.90532 | 0.03184 |
| 0.88612 | 0.03590 |
| 0.86540 | 0.03992 |
| 0.84323 | 0.04388 |
| 0.81970 | 0.04776 |
| 0.70890 | 0.05553 r |
| 0.74188 | 0.05858 |
| 0.71386 | 0.06181 |

TABLE 3-continued

| PE-X/C and Y/C coordinates for Tip End Station Airfoil coordinates at station 21 | |
|---|---|
| X/C | Y/C |
| 0.68498 | 0.06482 |
| 0.65535 | 0.06756 |
| 0.62508 | 0.07003 |
| 0.59429 | 0.07220 |
| 0.56310 | 0.07405 |
| 0.53162 | 0.07556 |
| 0.50000 | 0.07673 |
| 0.46835 | 0.07752 |
| 0.43679 | 0.07794 |
| 0.40545 | 0.07796 |
| 0.37447 | 0.07759 |
| 0.34396 | 0.07679 |
| 0.31406 | 0.07558 |
| 0.28489 | 0.07395 |
| 0.25656 | 0.07194 |
| 0.22921 | 0.06953 |
| 0.20293 | 0.06674 |
| 0.17786 | 0.06357 |
| 0.15409 | 0.06002 |
| 0.13173 | 0.05608 |
| 0.11089 | 0.05181 |
| 0.09165 | 0.04720 |
| 0.07408 | 0.04236 |
| 0.05826 | 0.03733 |
| 0.04424 | 0.03222 |
| 0.03207 | 0.02704 |
| 0.02182 | 0.02189 |
| 0.01351 | 0.01676 |
| 0.00718 | 0.01187 |
| 0.00282 | 0.00725 |
| 0.00043 | 0.00330 |
| 0.00000 | 0.00000 |
| 0.00155 | −0.00126 |
| 0.00507 | −0.00200 |
| 0.01054 | −0.00208 |
| 0.01790 | −0.00176 |
| 0.02713 | −0.00093 |
| 0.03815 | 0.00028 |
| 0.05094 | 0.00186 |
| 0.06544 | 0.00368 |
| 0.08159 | 0.00576 |
| 0.09934 | 0.00802 |
| 0.11860 | 0.01049 |
| 0.13930 | 0.01312 |
| 0.16136 | 0.01589 |
| 0.18472 | 0.01876 |
| 0.20928 | 0.02167 |
| 0.23497 | 0.02455 |
| 0.26168 | 0.02735 |
| 0.28933 | 0.03004 |
| 0.31782 | 0.03255 |
| 0.34702 | 0.03490 |
| 0.37684 | 0.03705 |
| 0.40717 | 0.03896 |
| 0.43788 | 0.04062 |
| 0.46886 | 0.04199 |
| 0.50000 | 0.04305 |
| 0.53117 | 0.04379 |
| 0.56224 | 0.04418 |
| 0.59309 | 0.04424 |
| 0.62361 | 0.04395 |
| 0.65367 | 0.04331 |
| 0.68314 | 0.04234 |
| 0.71192 | 0.04105 |
| 0.73987 | 0.03943 |
| 0.76690 | 0.03753 |
| 0.79289 | 0.03534 |
| 0.81773 | 0.03289 |
| 0.84132 | 0.03022 |
| 0.86357 | 0.02736 |
| 0.88439 | 0.02436 |
| 0.90370 | 0.02125 |
| 0.92142 | 0.01810 |
| 0.93747 | 0.01494 |

TABLE 3-continued

| PE-X/C and Y/C coordinates for Tip End Station Airfoil coordinates at station 21 | |
|---|---|
| X/C | Y/C |
| 0.95181 | 0.01185 |
| 0.96436 | 0.00883 |
| 0.97508 | 0.00602 |
| 0.98393 | 0.00341 |
| 0.99088 | 0.00119 |
| 0.99589 | −0.00066 |
| 0.99896 | −0.00181 |
| 1.00000 | −0.00263 |
| 1.00000 | 0.00263 |

Referring to Tables 3, 3RE and 3PE, there are twenty one (21) stations along the blade length. The column entitled Radius meter includes the distance in meters from the root end of the blade to station 1 (horizontal line across the blade). Column entitled Chord Meters includes the width component of the blade at that particular station. Twist degrees is the pitch of the twist of the blades relative to the hub with the degrees given in the direction of blade rotation.

Using the novel nineteen inch diameter condenser blade assemblies such as AC-A5 can result in up to an approximately 26% reduction in fan motor power with increased flow. For example, a current 3-ton AC unit uses ⅛ HP motor drawing 190 W to produce 2200 cfm with stamped metal blades (shown in FIGS. 1-3). The novel nineteen inch diameter twisted blade assemblies can use ⅛ HP motor drawing approximately 140 W to produce increased air flow. The use of a lower rpm smaller motor can reduce ambient noise levels produced by the condenser. The combination of improved diffuser and fan can also have an approximate 2 to approximately 3% increase in overall air conditioner efficiency. The novel blade assemblies can have an average reduction in summer AC peak load of approximately 40 to approximately 50 Watts per customers for utilities and up to approximately 100 W when combined with an ECM motor. The novel tapered, twisted blades with airfoils results in a more quiet fan operation than the stamped metal blades and the other blades of the prior art.

Table 4 shows a blade platform definition along twenty one (21) different station points along the novel large blade AC-C@ used in the 27.6" blade assemblies.

TABLE 4

| Station | Radius Meters | Chord Meters | Twist Degrees |
|---|---|---|---|
| 1 | 0.0825 | 0.1897 | 30.50 |
| 2 | 0.0959 | 0.1677 | 27.49 |
| 3 | 0.1094 | 0.1457 | 24.48 |
| 4 | 0.1228 | 0.1321 | 22.42 |
| 5 | 0.1361 | 0.1226 | 20.86 |
| 6 | 0.1495 | 0.1156 | 19.61 |
| 7 | 0.1629 | 0.1102 | 18.57 |
| 8 | 0.1763 | 0.1059 | 17.67 |
| 9 | 0.1897 | 0.1023 | 16.90 |
| 10 | 0.2031 | 0.0994 | 16.21 |
| 11 | 0.2165 | 0.0970 | 15.60 |
| 12 | 0.2299 | 0.0949 | 15.05 |
| 13 | 0.2433 | 0.0931 | 14.55 |
| 14 | 0.2567 | 0.0916 | 14.10 |
| 15 | 0.2701 | 0.0903 | 13.68 |
| 16 | 0.2835 | 0.0892 | 13.30 |
| 17 | 0.2969 | 0.0882 | 12.94 |
| 18 | 0.3103 | 0.0874 | 12.61 |
| 19 | 0.3237 | 0.0867 | 12.30 |

TABLE 4-continued

| Station | Radius Meters | Chord Meters | Twist Degrees |
|---|---|---|---|
| 20 | 0.3371 | 0.0861 | 12.01 |
| 21 | 0.3505 | 0.0856 | 11.74 |

Slicing the novel 27.6 inch blade into 21 sections from the root end to the tip end would include X/C and Y/C coordinates. These coordinates are given in a non-dimensional format, were x refers to the horizontal position, y refers to the vertical position and c is the chord length between the stations.

The following Table 4RP shows the coordinate columns represent the X/C and Y/C coordinates for the root end station portion (where the blades meet the hub) of the novel twisted blades for a 27.6 inch fan size.

TABLE 4

| RP-X/C, Y/C coordinates for Root End Station Airfoil coordinates at station 1 | |
|---|---|
| X/C | Y/C |
| 1.00000 | 0.00000 |
| 0.99904 | 0.00159 |
| 0.99615 | 0.00455 |
| 0.99130 | 0.00869 |
| 0.98450 | 0.01362 |
| 0.97579 | 0.01939 |
| 0.96520 | 0.02577 |
| 0.95277 | 0.03276 |
| 0.93855 | 0.04016 |
| 0.92260 | 0.04796 |
| 0.90498 | 0.05597 |
| 0.88576 | 0.06416 |
| 0.86501 | 0.07239 |
| 0.84283 | 0.08058 |
| 0.81928 | 0.08864 |
| 0.79448 | 0.09649 |
| 0.76850 | 0.10402 |
| 0.74146 | 0.11113 |
| 0.71345 | 0.11775 |
| 0.68459 | 0.12381 |
| 0.65499 | 0.12923 |
| 0.62477 | 0.13394 |
| 0.59404 | 0.13788 |
| 0.56292 | 0.14103 |
| 0.53153 | 0.14332 |
| 0.50000 | 0.14475 |
| 0.46845 | 0.14528 |
| 0.43702 | 0.14492 |
| 0.40581 | 0.14365 |
| 0.37497 | 0.14151 |
| 0.34461 | 0.13847 |
| 0.31485 | 0.13461 |
| 0.28582 | 0.12993 |
| 0.25764 | 0.12455 |
| 0.23042 | 0.11848 |
| 0.20427 | 0.11180 |
| 0.17930 | 0.10458 |
| 0.15561 | 0.09686 |
| 0.13332 | 0.08872 |
| 0.11251 | 0.08025 |
| 0.09326 | 0.07153 |
| 0.07565 | 0.06273 |
| 0.05976 | 0.05394 |
| 0.04564 | 0.04533 |
| 0.03334 | 0.03697 |
| 0.02293 | 0.02902 |
| 0.01443 | 0.02148 |
| 0.00788 | 0.01466 |
| 0.00329 | 0.00857 |
| 0.00066 | 0.00371 |
| 0.00000 | 0.00000 |

TABLE 4-continued

| RP-X/C, Y/C coordinates for Root End Station Airfoil coordinates at station 1 | |
|---|---|
| X/C | Y/C |
| 0.00131 | −0.00094 |
| 0.00460 | −0.00085 |
| 0.00983 | 0.00045 |
| 0.01699 | 0.00265 |
| 0.02602 | 0.00583 |
| 0.03688 | 0.00980 |
| 0.04953 | 0.01455 |
| 0.06393 | 0.01986 |
| 0.08002 | 0.02572 |
| 0.09772 | 0.03198 |
| 0.11698 | 0.03861 |
| 0.13771 | 0.04549 |
| 0.15984 | 0.05255 |
| 0.18328 | 0.05965 |
| 0.20795 | 0.06671 |
| 0.23376 | 0.07356 |
| 0.26061 | 0.08010 |
| 0.28840 | 0.08625 |
| 0.31702 | 0.09188 |
| 0.34638 | 0.09697 |
| 0.37634 | 0.10141 |
| 0.40680 | 0.10516 |
| 0.43765 | 0.10817 |
| 0.46876 | 0.11037 |
| 0.50000 | 0.11174 |
| 0.53126 | 0.11224 |
| 0.56242 | 0.11189 |
| 0.59335 | 0.11069 |
| 0.62392 | 0.10865 |
| 0.65402 | 0.10580 |
| 0.68353 | 0.10219 |
| 0.71233 | 0.09786 |
| 0.74030 | 0.09288 |
| 0.76733 | 0.08732 |
| 0.79331 | 0.08125 |
| 0.81814 | 0.07475 |
| 0.84172 | 0.06792 |
| 0.86395 | 0.06086 |
| 0.88475 | 0.05368 |
| 0.90404 | 0.04647 |
| 0.92173 | 0.03938 |
| 0.93776 | 0.03248 |
| 0.95206 | 0.02592 |
| 0.96458 | 0.01977 |
| 0.97527 | 0.01420 |
| 0.98408 | 0.00923 |
| 0.99099 | 0.00513 |
| 0.99596 | 0.00187 |
| 0.99898 | −0.00014 |
| 1.00000 | −0.00132 |
| 1.00000 | 0.00132 |

The following Table 4PE shows the coordinate columns representing the X/C and Y/C coordinates for the tip end station section of the 21 sections of the novel twisted 27.6 inch blades for an approximately 850 rpm running blades. These coordinates are given in a non-dimensional format, were x refers to the horizontal position, y refers to the vertical position and c is the chord length between the stations.

TABLE 4

| PE-X/C and Y/C coordinates for Tip End Station Airfoil coordinates at station 21 | |
|---|---|
| X/C | Y/C |
| 1.00000 | 0.00000 |
| 0.99904 | 0.00073 |
| 0.99615 | 0.00216 |
| 0.99130 | 0.00391 |

TABLE 4-continued

| PE-X/C and Y/C coordinates for Tip End Station Airfoil coordinates at station 21 | |
|---|---|
| X/C | Y/C |
| 0.98450 | 0.00586 |
| 0.97579 | 0.00801 |
| 0.96520 | 0.01029 |
| 0.95277 | 0.01268 |
| 0.93855 | 0.01515 |
| 0.92260 | 0.01768 |
| 0.90498 | 0.02023 |
| 0.88576 | 0.02279 |
| 0.86501 | 0.02534 |
| 0.84283 | 0.02788 |
| 0.81928 | 0.03038 |
| 0.79448 | 0.03283 |
| 0.76850 | 0.03522 |
| 0.74146 | 0.03753 |
| 0.71345 | 0.03973 |
| 0.68459 | 0.04182 |
| 0.65499 | 0.04378 |
| 0.62477 | 0.04559 |
| 0.59404 | 0.04724 |
| 0.56292 | 0.04872 |
| 0.53153 | 0.05001 |
| 0.50000 | 0.05110 |
| 0.46845 | 0.05197 |
| 0.43702 | 0.05261 |
| 0.40581 | 0.05301 |
| 0.37497 | 0.05316 |
| 0.34461 | 0.05302 |
| 0.31485 | 0.05261 |
| 0.28582 | 0.05191 |
| 0.25764 | 0.05094 |
| 0.23042 | 0.04969 |
| 0.20427 | 0.04815 |
| 0.17930 | 0.04631 |
| 0.15561 | 0.04416 |
| 0.13332 | 0.04167 |
| 0.11251 | 0.03888 |
| 0.09326 | 0.03579 |
| 0.07565 | 0.03246 |
| 0.05976 | 0.02892 |
| 0.04564 | 0.02525 |
| 0.03334 | 0.02148 |
| 0.02293 | 0.01763 |
| 0.01443 | 0.01373 |
| 0.00788 | 0.00988 |
| 0.00329 | 0.00619 |
| 0.00066 | 0.00284 |
| 0.00000 | 0.00000 |
| 0.00131 | −0.00180 |
| 0.00460 | −0.00324 |
| 0.00983 | −0.00434 |
| 0.01699 | −0.00514 |
| 0.02602 | −0.00560 |
| 0.03688 | −0.00574 |
| 0.04953 | −0.00560 |
| 0.06393 | −0.00525 |
| 0.08002 | −0.00468 |
| 0.09772 | −0.00392 |
| 0.11698 | −0.00295 |
| 0.13771 | −0.00177 |
| 0.15984 | −0.00041 |
| 0.18328 | 0.00110 |
| 0.20795 | 0.00272 |
| 0.23376 | 0.00440 |
| 0.26061 | 0.00608 |
| 0.28840 | 0.00776 |
| 0.31702 | 0.00938 |
| 0.34638 | 0.01096 |
| 0.37634 | 0.01246 |
| 0.40680 | 0.01387 |
| 0.43765 | 0.01516 |
| 0.46876 | 0.01630 |
| 0.50000 | 0.01728 |
| 0.53126 | 0.01808 |
| 0.56242 | 0.01868 |

TABLE 4-continued

| PE-X/C and Y/C coordinates for Tip End Station Airfoil coordinates at station 21 | |
|---|---|
| X/C | Y/C |
| 0.59335 | 0.01909 |
| 0.62392 | 0.01930 |
| 0.65402 | 0.01930 |
| 0.68353 | 0.01910 |
| 0.71233 | 0.01870 |
| 0.74030 | 0.01809 |
| 0.76733 | 0.01730 |
| 0.79331 | 0.01632 |
| 0.81814 | 0.01517 |
| 0.84172 | 0.01387 |
| 0.86395 | 0.01243 |
| 0.88475 | 0.01089 |
| 0.90404 | 0.00928 |
| 0.92173 | 0.00763 |
| 0.93776 | 0.00596 |
| 0.95206 | 0.00432 |
| 0.96458 | 0.00273 |
| 0.97527 | 0.00125 |
| 0.98408 | −0.00010 |
| 0.99099 | −0.00124 |
| 0.99596 | −0.00211 |
| 0.99898 | −0.00260 |
| 1.00000 | −0.00292 |
| 1.00000 | 0.00292 |

Figure 13:
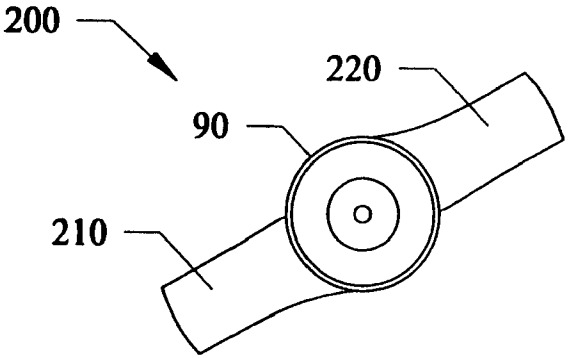
FIG. 13 is a bottom view of a second preferred embodiment of a two condenser blade assembly.

FIG. 13 is a bottom view of a second preferred embodiment of a two condenser blade assembly 200. Here two twisted blades 210, 220 each similar to the ones shown in FIGS. 7-12 can be mounted on opposite sides of a hub 90, and being approximately 180 degrees from one another.

Figure 14:
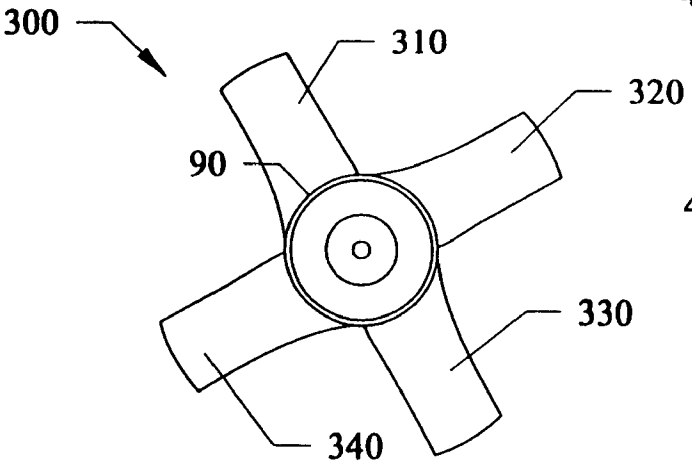
FIG. 14 is a bottom view of a third preferred embodiment of a four condenser blade assembly.

FIG. 14 is a bottom view of a third preferred embodiment of a four condenser blade assembly 300. Here four twisted blades 310, 320, 330, 340 each similar to the ones shown in FIGS. 7-12 can be equally spaced apart from one another (approximately 90 degrees to one another) while mounted to a hub 90.

Figure 15:
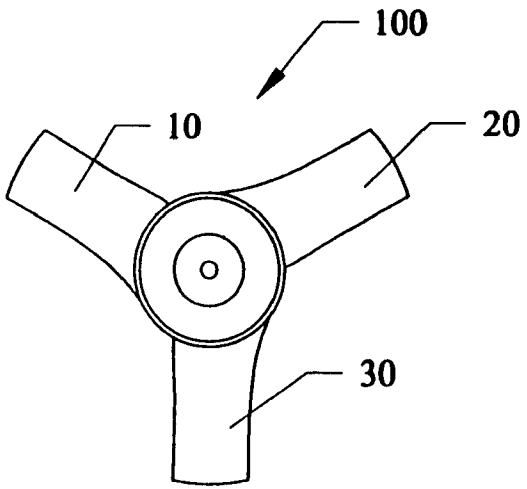
FIG. 15 is a bottom view of the three condenser blade assembly of FIGS. 4-8.

FIG. 15 is a bottom view of the three condenser blade assembly 100 of FIGS. 4-8 with three blades 10, 20, and 30 previously described.

Figure 16:
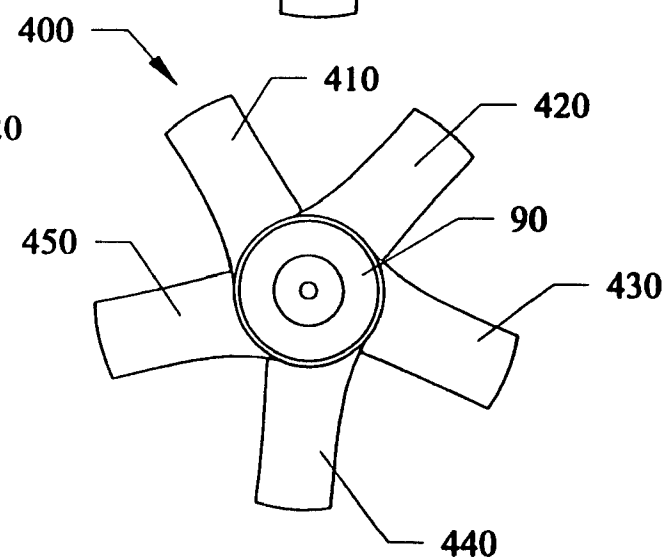
FIG. 16 is a bottom view of a fourth preferred embodiment of a five condenser blade assembly.

FIG. 16 is a bottom view of a fourth preferred embodiment of a five condenser blade assembly 400. Here, five twisted blades 410, 420, 430, 440 and 45 each similar to the ones shown in FIGS. 7-12 can be equally spaced apart from one another (approximately 72 degrees to one another) while mounted to hub 90.

Figure 17:
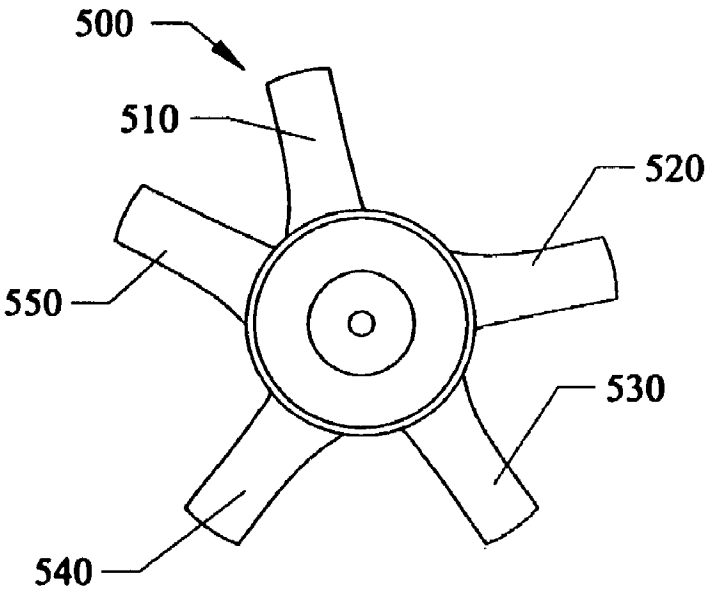
FIG. 17 is a bottom view of a fifth preferred embodiment of an asymmetrical configuration of a five condenser blade assembly.

FIG. 17 is a bottom view of a fifth preferred embodiment of an asymmetrical configuration of a five condenser blade assembly 500. For this asymmetrical embodiment, the novel twisted blades of the condenser fan are not equally spaced apart from one another. This novel asymmetrical spacing produces a reduced noise level around the AC condenser, and the five bladed configuration allows a lower rpm range to create an equivalent flow. This technology has been previously developed for helicopter rotors, but never for air conditioner condenser fan design. See for example, Kernstock, Nicholas C., Rotor & Wing, Slashing Through the Noise Barrier, August, 1999, *Defense Daily Network*, cover story, pages 1-11.

Figure 18:
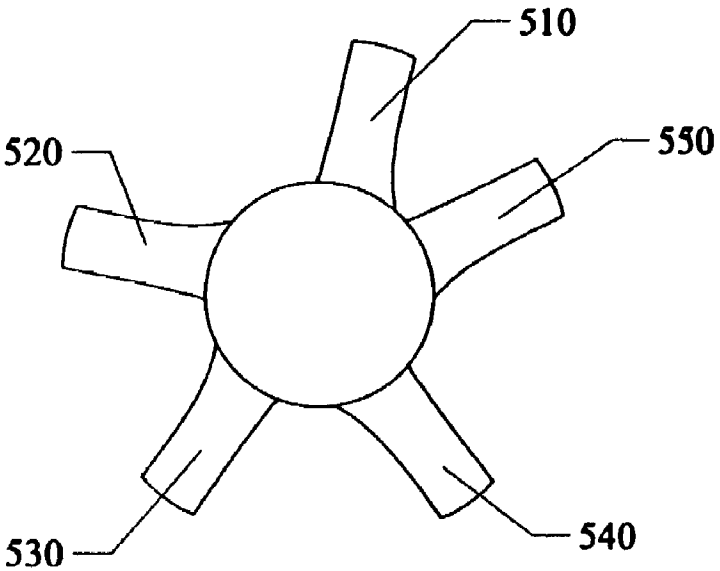
FIG. 18 is a top view of the asymmetrical configuration blade assembly of FIG. 17.

In the novel embodiment of FIGS. 17-18, the sound of air rushing through an evenly spaced fan rotor creates a resonance frequency with the compressors hum, causing a loud sound. But if the blades are not equally spaced, this resonance is reduced producing lower ambient sound levels with the noise less concentrated in a narrow portion of the audible frequency. With the invention, this is accomplished using a five-bladed fan design where the fan blades are centered unevenly around the rotating motor hub. Table 5 describes the center line blade locations on the 360 degree hub for the asymmetrical configuration.

TABLE 5

Asymmetrical Fan Blade Locations

| Blade Number | Degree of center-line around hub |
|---|---|
| #510 | 79.0117 |
| #520 | 140.1631 |
| #530 | 211.0365 |
| #540 | 297.2651 |
| #550 | 347.4207 |

Comparative measurement of fan noise showed that the asymmetrical blade arrangement can reduce ambient noise levels by approximately 1 decibel (dB) over a symmetrical arrangement.

Figures 19, 20, 21:
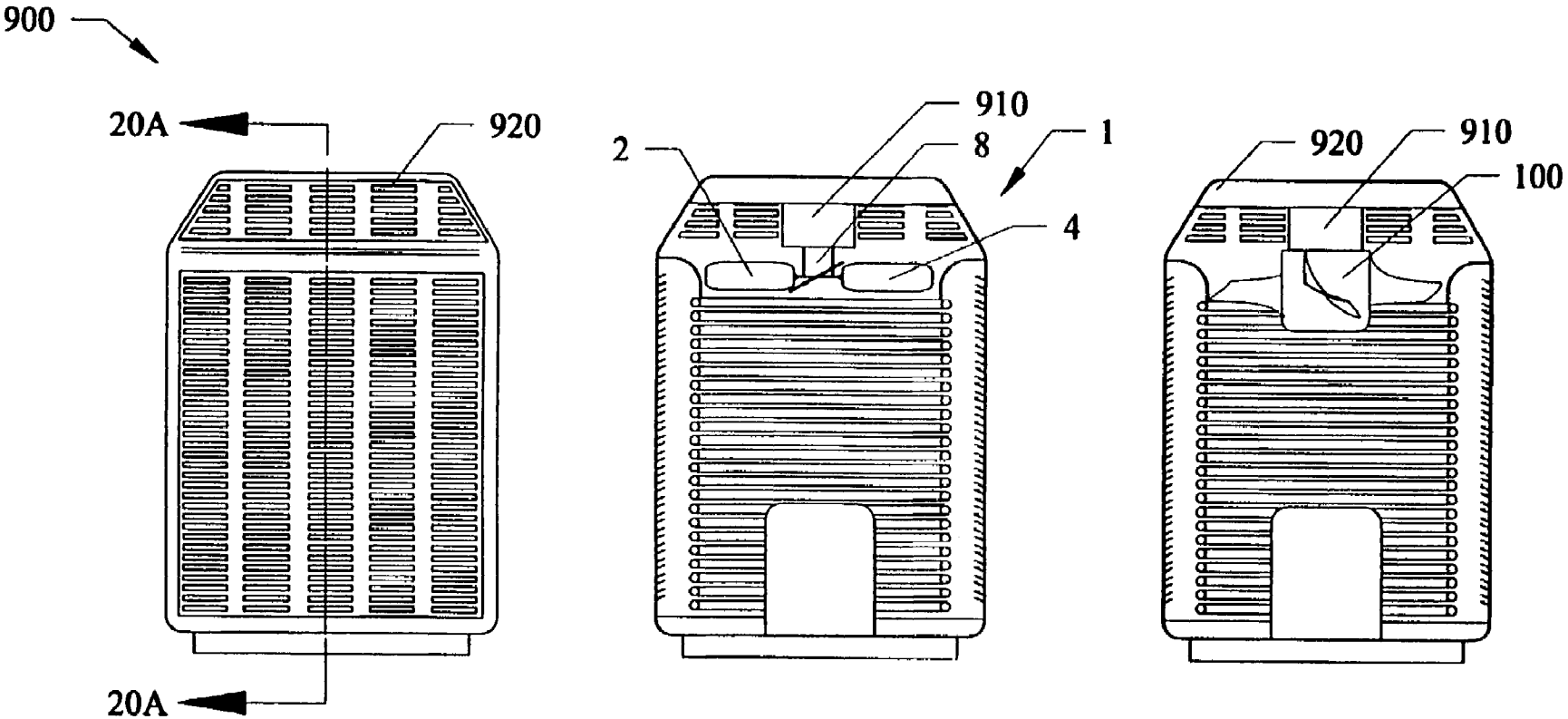
FIG. 19 (PRIOR ART)
FIG. 20 (PRIOR ART)
FIG. 21 (PRIOR ART)
FIG. 19 is a side view of a prior art commercial outdoor air conditioning compressor unit using the prior art condenser fan blades of FIGS. 1-3.
FIG. 20 is a cross-sectional interior view of the prior art commercial air conditioning compressor unit along arrows 20A of FIG. 19 showing the prior art blades of FIGS. 1-3.
FIG. 21 is a cross-sectional interior view of the compressor unit containing the novel condenser blade assemblies of the preceding figures.

FIG. 19 is a side view of a prior art commercial outdoor air conditioning compressor unit 900 using the prior art condenser fan blades 2, 4, 6 of FIGS. 1-3. FIG. 20 is a cross-sectional interior view of the prior art commercial air conditioning compressor unit 900 along arrows 20A of FIG. 19 showing the prior art blades 2, 4 of FIGS. 1-3, attached to a base for rotating hub portion 8.

FIG. 21 is a cross-sectional interior view of the compressor unit 900 containing the novel condenser blade assemblies 100, 200, 300, 400, 500 of the preceding figures. The novel invention embodiments 100-500 can be mounted by their hub portion to the existing base under a grill lid portion 920.

In addition, the invention can be used with improved enhancements to the technology (diffusers) as well as a larger fans for high-efficiency of heat pumps. In tests conducted, specifically designed conical diffusers were shown to improve air moving performance of the 19" blade assemblies, such as fan AC-A5, at approximately 840 rpm from approximately 1660 cfm with a standard top to approximately 2015 cfm with the diffuser, and increase in flow of approximately 21%. The diffuser in the preferred embodiment includes a conical outer body upstream of the fan motor to reduce swirl and improves diffuser pressure recovery. Testing showed that the conical center body increased flow by approximately 5 to approximately 20 cfm while dropping motor power by approximately 2 to approximately 5 Watts.

In addition, the invention can be used with variable speed ECM motors for further condenser fan power savings. This combination can provide both greater savings (over 100 Watts) and lower outdoor unit sound levels which are highly desirable for consumers.

Modified Interior Sidewall Diffuser Housing Embodiment

Figure 23:
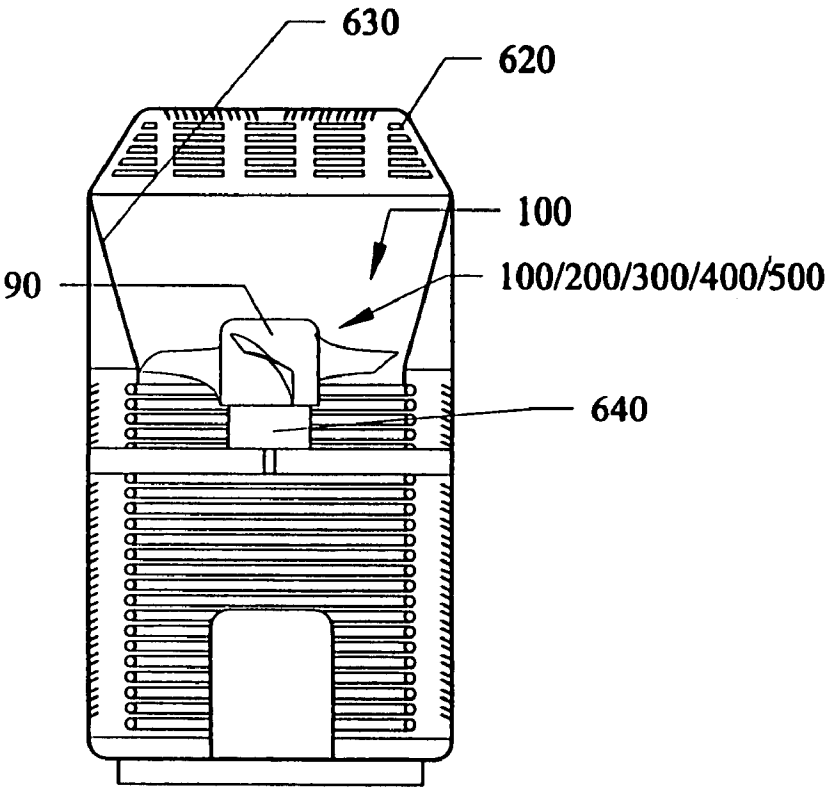
FIG. 23 is a cross-sectional interior view of the diffuser housing inside the compressor unit of FIG. 22 along arrows 23A.
Figure 22:
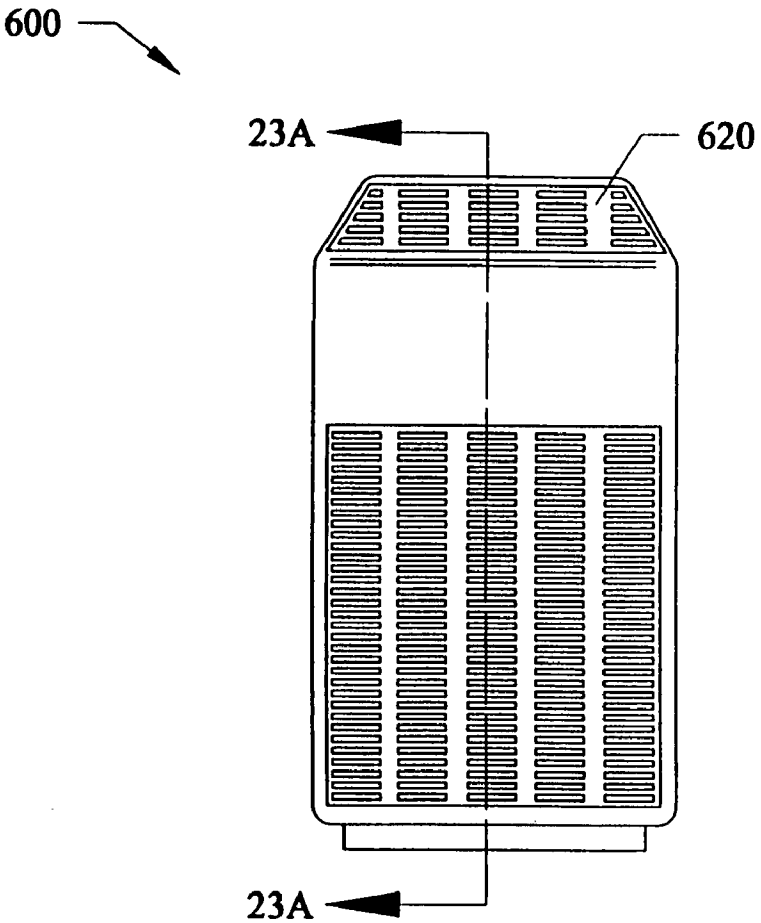
FIG. 22 is a side view of a preferred embodiment of an outdoor air conditioning compressor unit with modified diffuser housing.

FIG. 22 is a side view of a preferred embodiment of an outdoor air conditioning compressor unit 600 with modified diffuser housing having a conical interior walls 630. FIG. 23 is a cross-sectional interior view of the diffuser housing interior conical walls 630 inside the compressor unit 600 of FIG. 22 along arrows 23A.

FIGS. 22-23 shows a novel diffuser interior walls 630 for use with a condenser unit 600 having a domed top grill 620 above a hub 90 attached to blades 100, and the motor 640 beneath the hub 90. The upwardly expanding surface 630 of the conical diffuser allows for an enhanced airflow out through the dome shaped grill 620 of the condenser unit 600 reducing any pressure rise that can be caused with existing systems, and converting the velocity pressure produced by the axial flow into state pressure resulting in increased flow. This occurs to the drop in air velocity before it reaches the grill assembly 620. Dome shaped grillwork 620 further reduces fan pressure rise and reduces accumulation of leaves, and the like.

Figure 24:
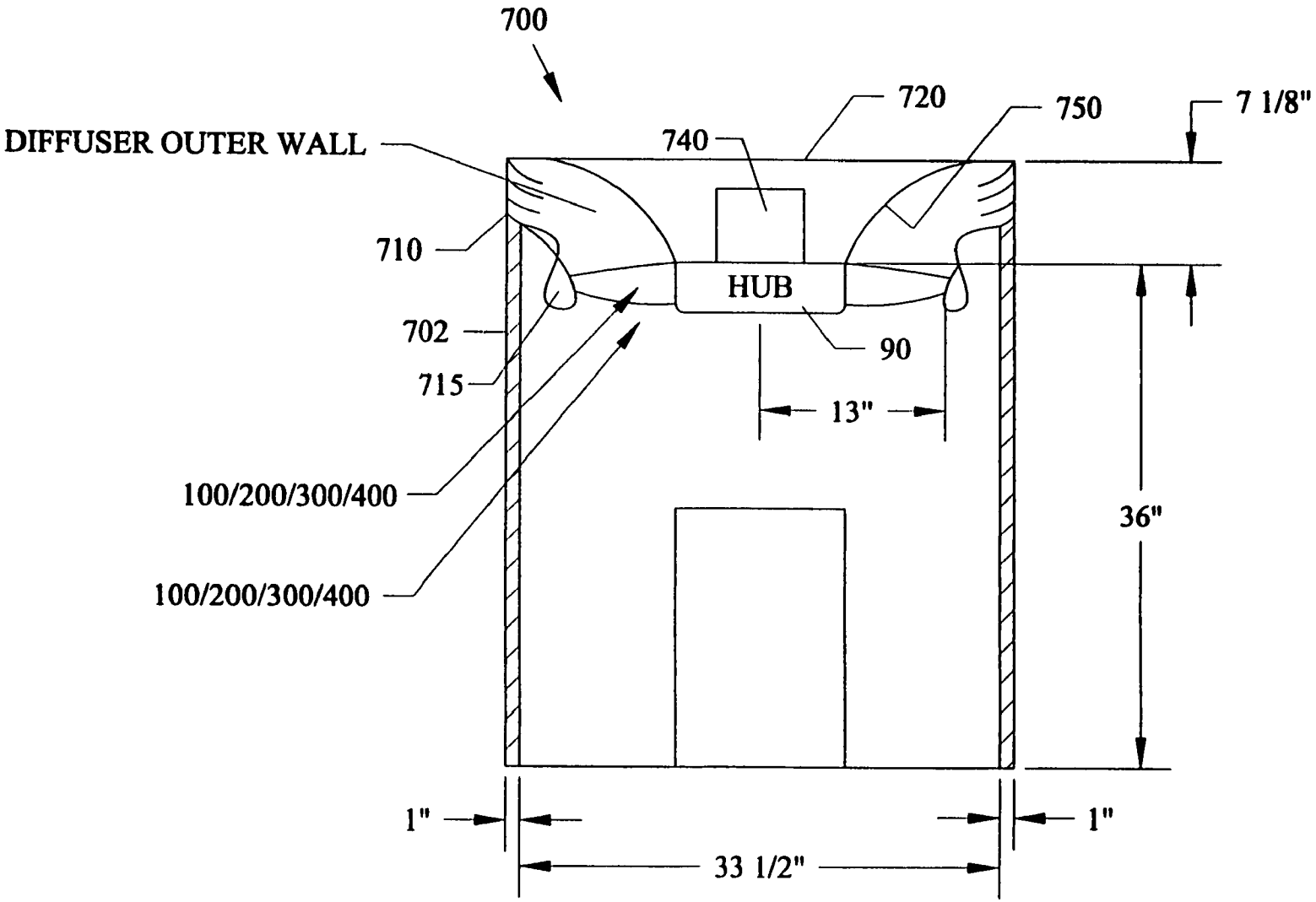
FIG. 24 is a cross-sectional interior view of another embodiment of the novel diffuser housing inside the compressor unit of FIG. 22 along arrows 23A.

FIG. 24 is a cross-sectional interior view of another embodiment of the novel diffuser housing inside the compressor unit of FIG. 22 along arrows 23A. FIG. 24 shows another preferred arrangement 700 of using the novel condenser fan blade assemblies 100/200/300/400 of the preceding figures with novel curved diffuser side walls 750. FIG. 24 shows the use of a condenser having a flat closed top 720 with upper outer edge vents 710 about the unit 700, and a motor 740 above a hub 90 that is attached to fan blades 100/200/300/400. Here, the bottom edge of an inlet flap 715 is adjacent to and close to the outer edge tip of the blades 100/200/300/400. The motor housing includes novel concave curved side walls 750 which help direct the airflow upward and to the outer edge side vents 710 of the unit 700. Additional convex curved sidewalls 710-715 on a housing interior outer side wall 702 also direct airflow out to the upper edge side vents 710. The combined curved side walls 750 of the motor housing the curved housing outer interior sidewalls function as a diffuser to help direct airflow. Here, exit areas are larger in size than the inlet areas resulting in no air backpressure from using the novel arrangement.

The novel diffuser and condenser unit 600 of FIGS. 22-24 can be used with any of the preceding novel embodiments 100, 200, 300, 400, 500 previously described.

Conical Interior Diffuser Walls & Hub Mounted Conical Cap

As previously described, achieving very low sound levels in outdoor air conditioning units is a very important objective for air conditioning condenser fan system manufacturers.

Figure 25:
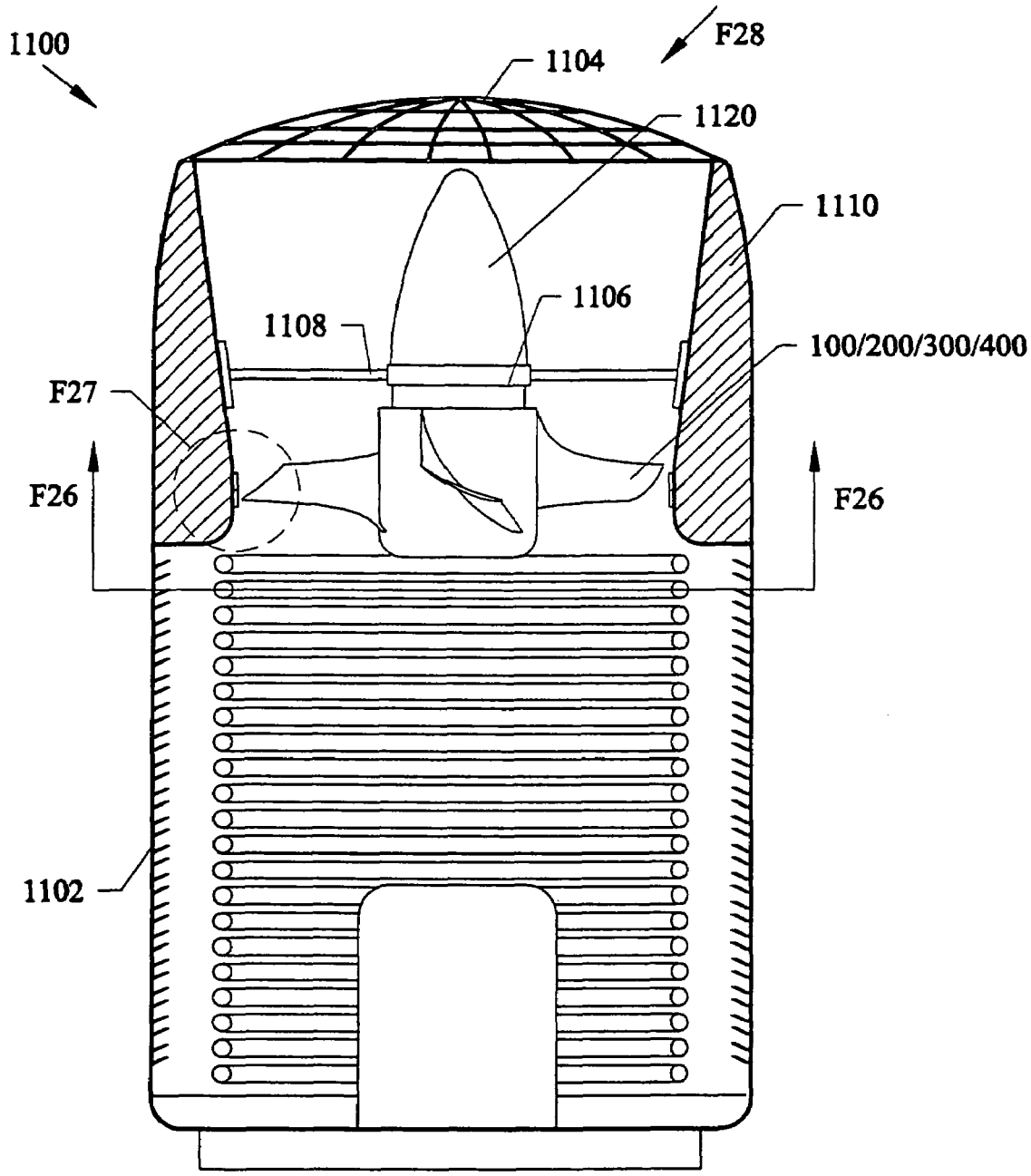
FIG. 25 is a cross-sectional interior view of another embodiment of a novel diffuser housing with both a conical outwardly expanding convex curved diffuser wall, and a hub mounted conical center body.

FIG. 25 is a cross-sectional interior view of another embodiment 1100 of a novel diffuser housing 1102 with both a conical outwardly expanding convex curved diffuser wall 1110 that can be formed from acoustic fibrous insulation material, such as but not limited to fiberglass, and the like, and a hub mounted conical center body 1120, that can also be formed from similar material, and the like. This embodiment can use either conventional blades or anyone of the novel blades previously described that are mounted to a hub 1106 that is mounted by struts 1108 to the inside of the condenser housing 1102. Either or both the diffuser walls 1110 and the conical center body 1120 can have rounded surfaces for reducing backpressure problems over the prior art. The combination of the novel outwardly expanding conical shaped diffuser interior walls and the hub mounted conical center body has been shown to reduce undesirable sound noise emissions from an air conditioner condenser. The cone shaped body can drop motor power use by between approximately 2 to approximately 5 Watts, and show an improvement in air flow performance of at least approximately 1% over prior art systems.

Porous Strip Members and Porous Blade Edges Embodiments

The inventors have determined that the functionality of an air conditioner condenser exhaust is essentially analogous to a ducted fan in terms of performance. Research done over the last twenty years has shown that tip clearance of the fan blades to the diffuser walls is critical to the performance of ducted fans. See: R. Ganesh Rajagopalan and Z. Zhang, "Performance and Flow Field of a Ducted Propeller," American Institute of Aeronautics and Astronautics, 25$^{th}$ *Joint Propulsion Conference*, AIAA_89_2673, July 1989; and Anita I.

Abrego and Robert W. Bulaga, "Performance Study of a Ducted Fan System," NASA Ames Research Center, Moffet Field, Calif., *American Helicopter Society Aerodynamics, Acoustics and Test Evaluation Technical Specialists Meeting*," San Francisco, Calif., Jan. 23-25, 2002.

Unfortunately, very low tip clearances, while very beneficial, are practically difficult in manufacture due to required tolerances. Should fan blades strike a solid diffuser wall, the fan blades or motor may be damaged or excessive noise created. Thus, in air conditioner fan manufacturer, the fan blades typically have gap of approximately 0.2 to approximately 0.4 inches in the fan clearance to the steel sidewall diffuser. This large tip clearance has a disadvantageous impact on the ducted fan's performance.

Against the desirable feature of low sound levels we also examined interesting work done at NASA Langley Research Center looking at how porous tipped fan blades in jet turbofan engines can provide better sound control by greatly reducing vortex shedding from the fan blade tips—a known factor in the creation of excessive fan noise. Khorrami et al. showed experimental data verifying the reduced vortex shedding as well as the lower produced sounds levels. See: Mehdi R. Khorrami, Fei Li and Meelan Choudhari, 2001. "A Novel Approach for Reducing Rotor Tip Clearance Induced Noise in Turbofan Engines" NASA Langley Research Center, American Institute of Aeronautics and Astronautics, 7$^{th}$ *AIAA/CEAS Aeroacoustics Conference,* Maastrictht, Netherlands, 28-30 May, 2001.

Based on the above research, the inventors have determined that the use of porous fan tips such as that described in the work by Khorrami et al. can be applied to reduce fan tip noise in outdoor condenser fan housings and heat pump housings. The inventors further determined that a porous diffuser sidewall would accomplish similar results. To accomplish this, the inventors use a porous medium to line the conical diffuser wall and settled on open cell polyurethane foam. This was done by obtaining commercially available approximately 3/16" open cell plastic foam approximately 1½" wide and applying it to the inner wall of the diffuser assembly swept by the fan blades.

We estimated the impact of the invention by carefully measuring performance of two of our fans. Sound levels were measured according to ARI Standard 270-1995. The results are show in the tables below, indicate a dramatic improvement in flow due to reduced tip clearance as well as large sound reduction advantages of approximately 2 to approximately 3 db (approximately 15 to approximately 20% reduction in sound level).

Impact on Performance of Reduced Tip Clearance using open cell foam sound control strips, is shown in Table 6 and Table 7.

TABLE 6

| A5 Fan with 8 pole motor (850 rpm) with conical diffuser | | | | |
|---|---|---|---|---|
| Case | Flow | Power | Normalized CFM/W | dBA |
| As is (~¼" clearance) | 2015 | 130 W | 15.5 | 62.0 |
| Tip clearance < 1/32" | 2300 | 141 W | 16.3 | 60.0 |

TABLE 7

| A Fan with 6 pole motor (1100 rpm) with conical diffuser | | | | |
|---|---|---|---|---|
| As is (~¼" clearance) | 2400 | 139 W | 17.3 | 64.5 |
| Tip clearance (<1/32" | 2610 | 145 W | 18.0 | 61.0 |

The novel sound control and vortex shedding control strip can be used with either this improved AC diffuser configuration or with conventional AC diffuser housings to safely reduce fan tip clearance while improving air moving efficiency and reducing ambient sound levels.

Figure 26:
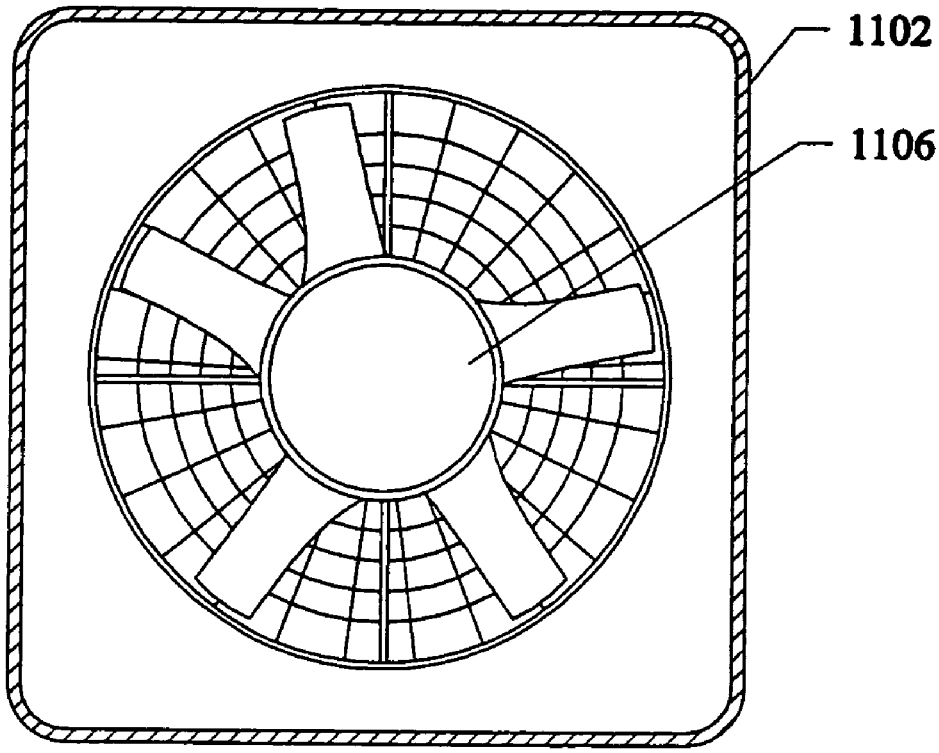
FIG. 26 is a cross-sectional bottom view of the housing of FIG. 25 along arrows F26.
Figure 27:
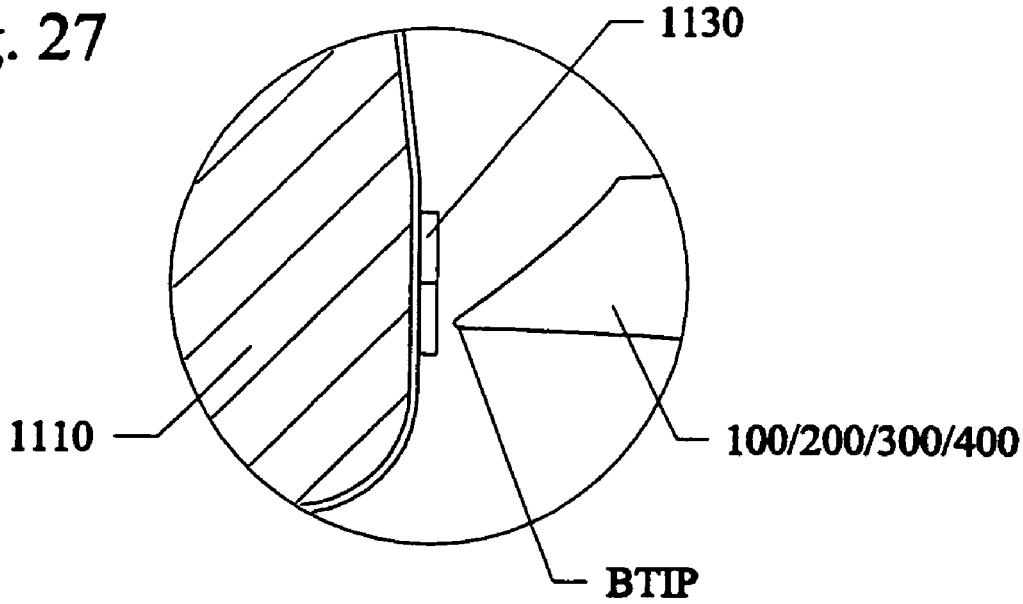
FIG. 27 is an enlarged view of the wall mounted vortex shedding control strip of FIG. 25.
Figure 28:
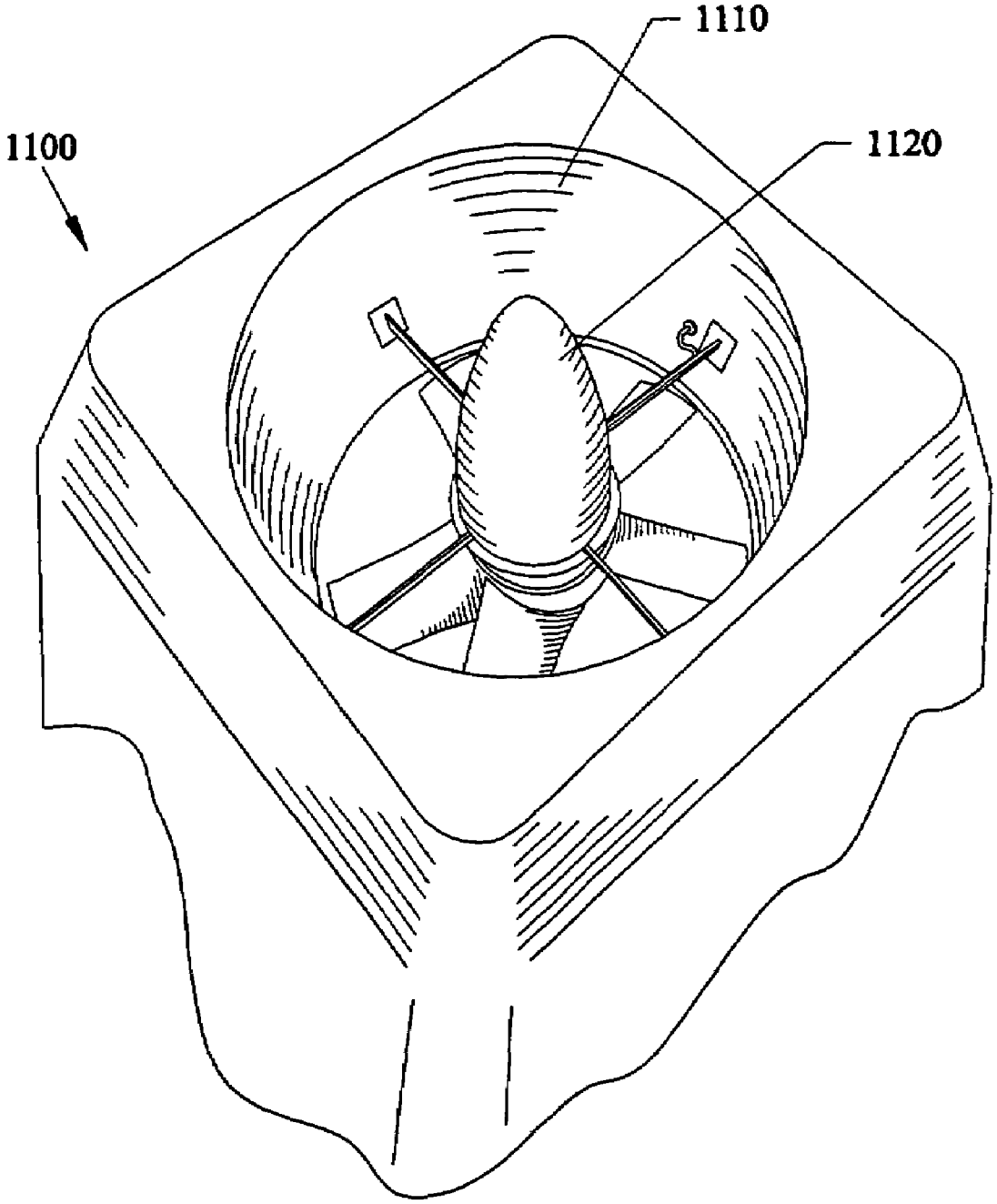
FIG. 28 is a top perspective view of the housing of FIG. 25 along arrow F28.

FIG. 26 is a cross-sectional bottom view of the housing 1102 of FIG. 25 along arrows F26. FIG. 27 is an enlarged view of the wall mounted vortex shedding control strip 1120 of FIG. 25. FIG. 28 is a top perspective view of the housing 1102 of FIG. 25 along arrow F28.

Referring to FIGS. 25-28, a strip member, such as but not limited to a porous open cell foam strip having dimensions of approximately 1 & ½ inches wide by approximately 3/16 of an inch thick can be placed as a lining on the interior walls of the diffuser housing where the tips of the rotating blades sweep closest to the interior walls. The strips can have a length completely around the interior walls, and reduce the clearance space between the walls and the rotating blade tips. This novel liner can be retrofitted into existing condenser housings and applied as a strip member with one sided tape. The foam material will not hurt the rotating blades since the blades can easily cut into the foam liner, providing a safety factor. The liner has the double advantage of both improving air flow by safely reducing tip clearance between the rotating blades and the interior wall surface of the housing with an inexpensive and easy to apply strip member, as well as reducing sound level noise emissions from the housing. The novel liner strip safely reduces fan blade tip clearance improving air moving performance while breaking up fan tip vortex shedding which contributes to high fan noise levels.

Reducing the fan blade tip clearances within the housing can increase air flow by up to approximately 15%. As the shaft power requirement increases between the square and the cube of the air flow quantity, this can represent a measured improvement in the air moving efficiency of up to approximately 45%. At the same time, we have measured sound reductions of at least approximately 2 decibels, which translates to up to approximately 15% more quiet to the human ear.

The novel porous liner can be used with or without the novel blade configurations of the previous embodiments.

Figure 29:
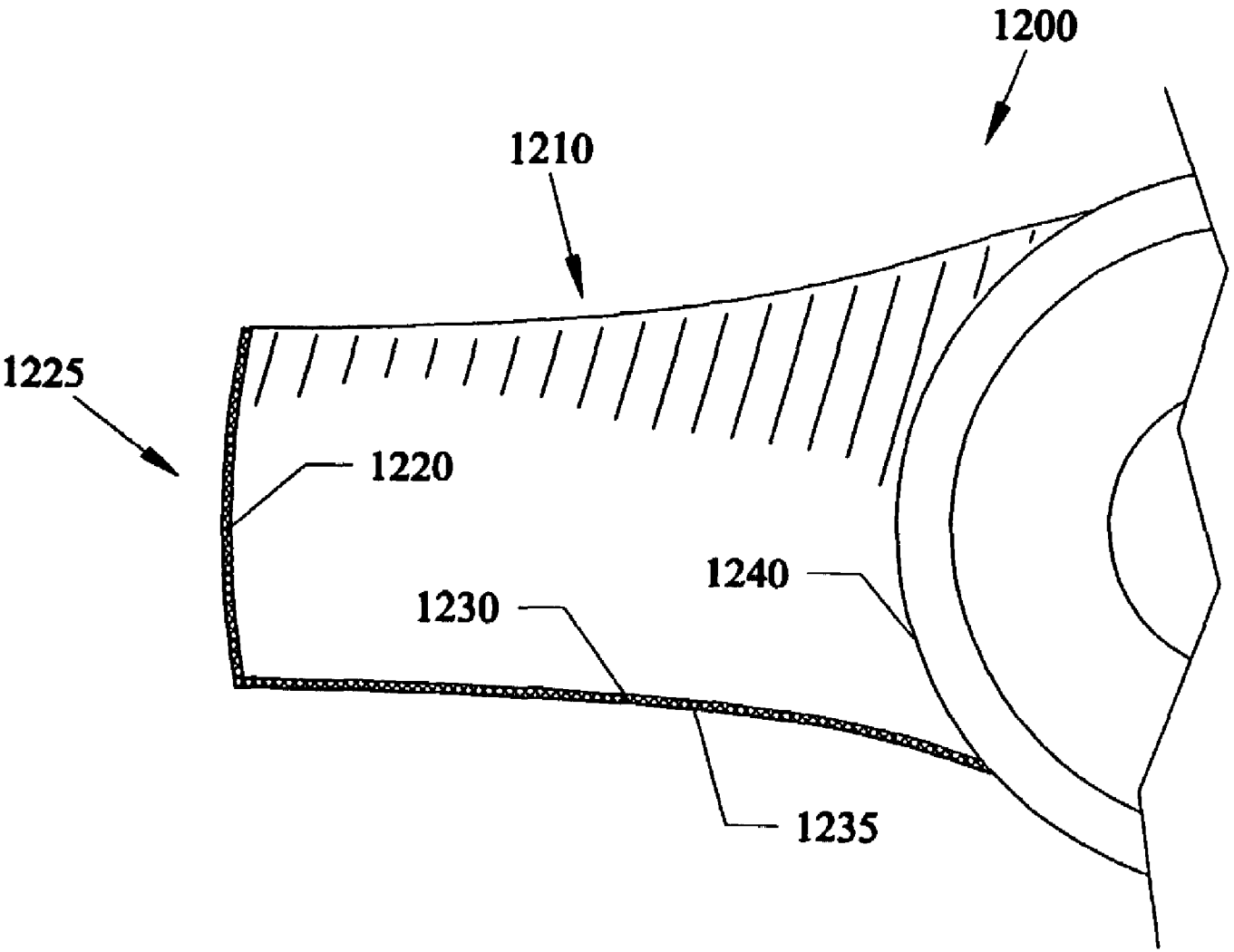
FIG. 29 is a top view of another embodiment of a porous foam strip along either or both a blade tip edge or a blade trailing edge.

FIG. 29 is a top view of another embodiment 1200 of a porous foam strip 1225, 1235, similar to that described above, along either or both a blade tip edge 1220 or a blade trailing edge 1230 of a condenser blade 1200.

This embodiment can be used with or without any of the other above embodiments, and can also have the double effect of safely reducing tip clearance between the rotating blades and the interior wall surface of the diffuser housing with the strip member, as well as reducing sound level noise emissions from the housing.

Although a porous open cell foam strip is described in these embodiments, the invention can use other separately applied materials having porous characteristics such as porous fabrics, porous ceramics, activated carbon, zeolites, and other solids with porous surfaces. Additionally, the surfaces of the interior walls of the diffuser can be porous, as well as the blade tip edges, and/or on the blade trailing edges can also be porous to break up vortex shedding. For example, porous surfaces such as pitted indentations, and the like, can be applied to interior surface portions of the diffuser housing adjacent to where the rotating blades sweep.

Temperature Based Speed Control

Figure 30:
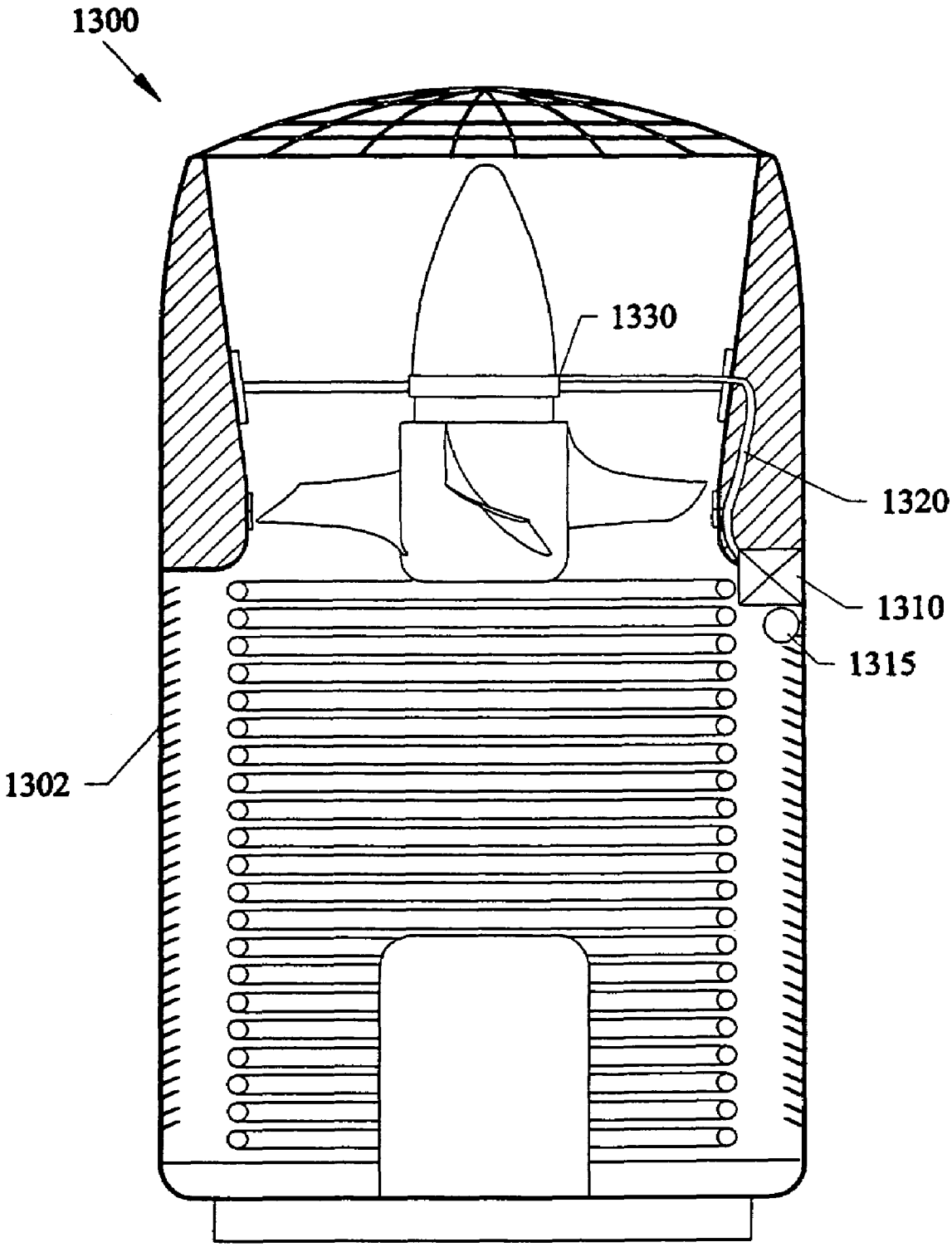
FIG. 30 is another cross-sectional view of another embodiment of the compressor housing of FIG. 25 with blade rotation temperature control unit.

FIG. 30 is another cross-sectional view of another embodiment 1300 of the compressor housing 1302 of FIG. 25 with blade rotation temperature control unit. A temperature sensor 1315 can be located external to the outside air conditioner condenser to detect outside temperatures, and be connected to a motor control circuit (PWM) 1310, which is connected by control wiring 1320 to an ECM motor 1330 inside of the condenser. When used with an ECM motor, the fan's speed can be varied according to outdoor temperature to produce maximum AC efficiency at the hottest times and maximum sound reduction at other times. ECM motors also approximately double the savings achieved by the improved fan design configurations.

When the fan blades are coupled to an ECM motor, the measured savings increase from roughly 45 Watts to approximately 100 Watts with the test apparatus. Not only are saving increased, but it is then possible with the ECM motor to vary continuously the motor speed without sacrificing its efficiency. Within the preferred embodiment of the invention, the fan speed would be low (approximately 750 rpm) when the temperature outdoors was less than a factory preset level (e.g. 90 F). This would provide greatest fan power savings (greater than approximately 110 Watts) as well as very quiet operation during sensitive nighttime hours and other times when occupancy and neighbors are likely to be outdoors. However, when the temperature was above approximately 90 F, the ECM motor could move to a higher speed (e.g. 1000 rpm) where the produced air flow would result in greatest air conditioner efficiency and cooling capacity with fan-only power savings still greater than 80 Watts. Thus, this control scheme would provide both maximum AC efficiency in the hottest periods as well as most quiet operation at other times which is highly desirable for home owners.

Figure 31:
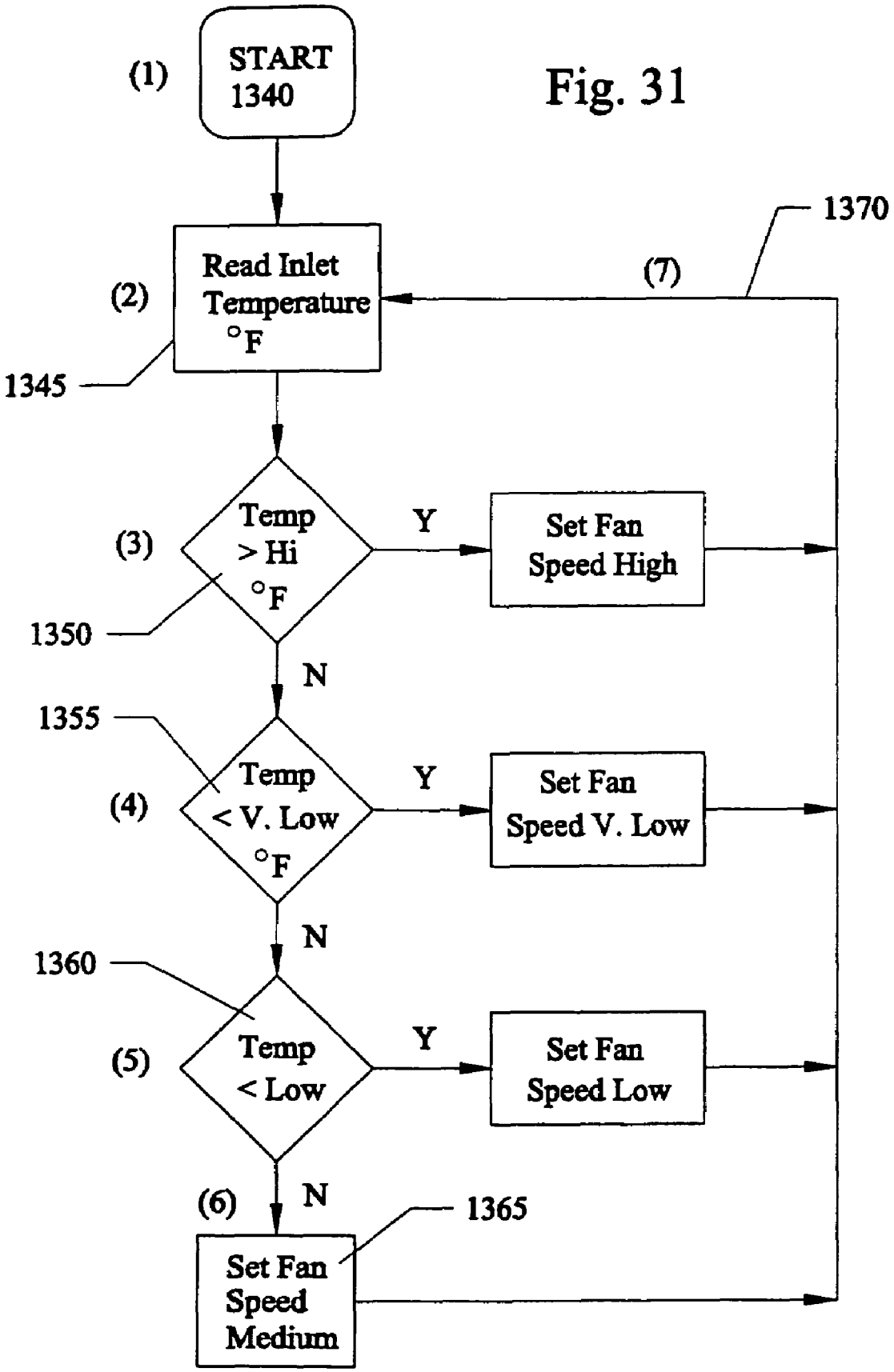
FIG. 31 is a condenser fan speed control flow chart for use with the blade rotation temperature control unit of FIG. 30.

FIG. 31 is a condenser fan speed control flow chart for use with the blade rotation temperature control unit of FIG. 30. An example of set points can include a high temperature Hi=89 F, and a low temperature of Low=83 F, with a very low temperature of Very low=65 F (heating operation). The fan can be powered by an ECM motor with pulse width modulation signals (PWM) sent according to the selected blade rotation speed. The control unit can be a digital control unit such as one manufactured by Evolution Controls, Inc. with the control signal provided by a thermistor.

The condenser fan speed control logic can function in the following fashion according to the flow control diagram shown in FIG. 31.

1340. (START) At the start of each new air conditioning or heating control cycle (when outdoor unit receives request from thermostat to come on) logic sequence begins.

1345. Outdoor temperature thermistor reads the temperature by the inlet of the unit

1350. It the temperature is greater than the HI setting (e.g. 89 F), the fan speed is set to high (e.g. 900 rpm) where it remains until the beginning of the next cycle. Else continue to next step.

1355. If the temperature is less than the Very low setting (e.g. 65 F), the fan speed is set to very low (e.g. 650 rpm) where it remains until the beginning of the next cycle. Else continue to next step.

1360. If the temperature is less than the Low setting (e.g. 83 F), the fan speed is set to low (e.g. 750 rpm) where it remains until the beginning of the next cycle. Else continue to next step.

1365. Set the fan speed is set to medium (e.g. 800 rpm) where it remains until the beginning of the next cycle.

1370. Wait until next control cycle begins to read new temperature and determine new fan speed.

Additional Condenser Fan Blade Assemblies with Twisted Blades

Figure 32:
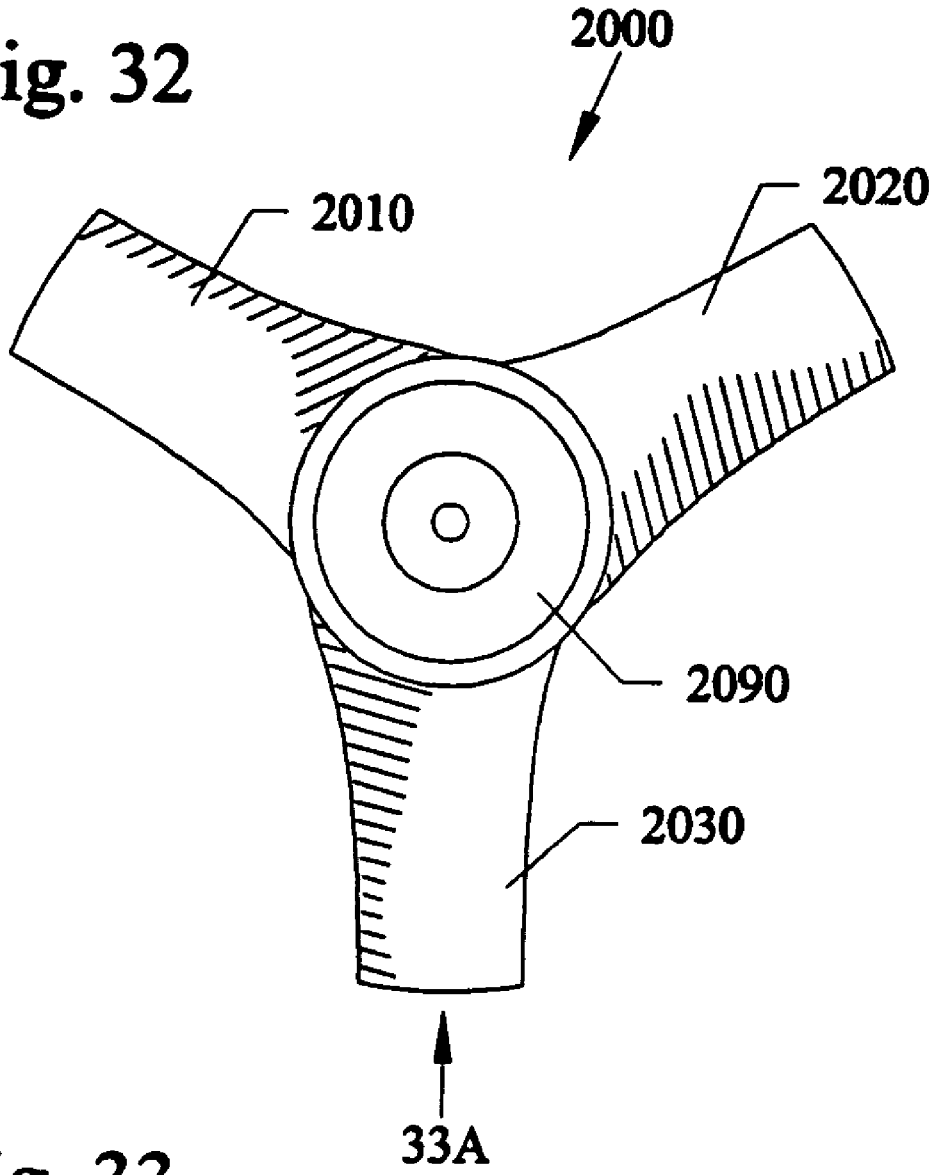
FIG. 32 is a bottom perspective view of another preferred embodiment of a three condenser blade assembly of the invention.
Figure 33:
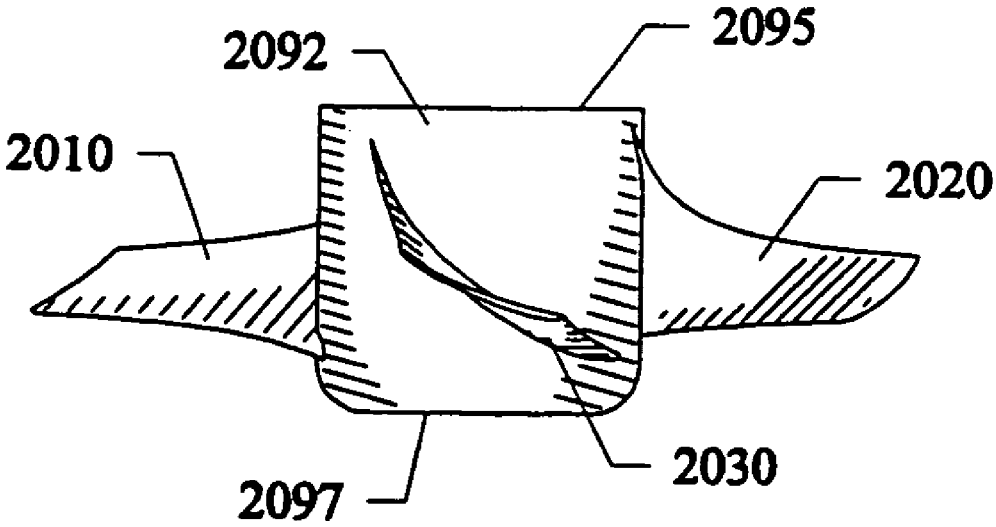
FIG. 33 is a side view of the three blade assembly of FIG. 32 along arrow 33A.
Figure 34:
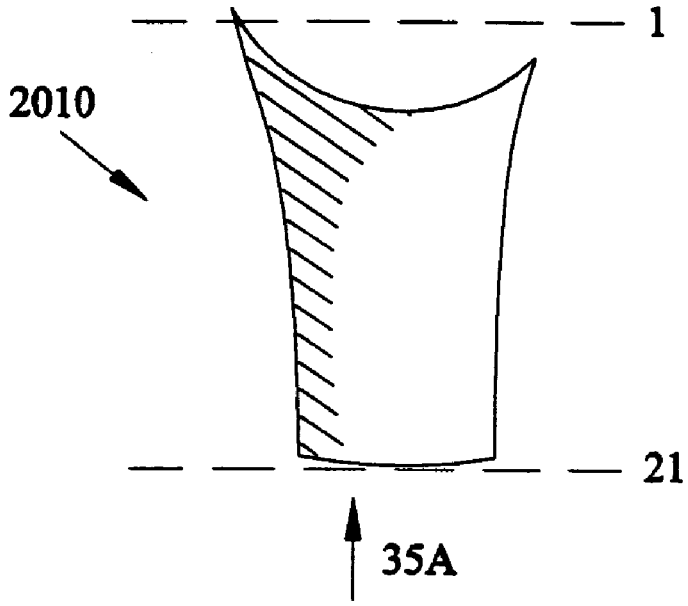
FIG. 34 is a top view of a single condenser blade of FIGS. 32-33.
Figure 35:
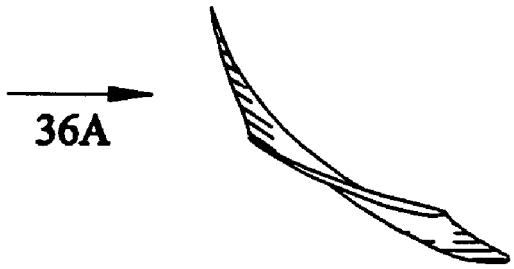
FIG. 35 is a tip end view of the single blade of FIG. 34 along arrow 35A.
Figure 36:
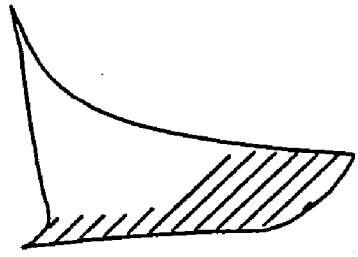
FIG. 36 is a side view of the single blade of FIG. 35 along arrow 36A.

FIG. 32 is a bottom perspective view of another preferred embodiment of a three condenser blade assembly 2000 of the invention. FIG. 33 is a side view of the three blade assembly 2000 of FIG. 32 along arrow 33A. FIG. 34 is a top view of a single condenser blade 2010 of FIGS. 32-33. FIG. 35 is a tip end view of the single blade 2010 of FIG. 34 along arrow 35A. FIG. 36 is a side view of the blade 2010 of FIG. 35 along arrow 36A.

Referring to FIGS. 32-36, a central hub 2090 can include a bottom end 2095 for attaching the assembly 2000 to standard or novel condenser housing, such as those previously described. The central hub 2090 can include a top end 2097 and sides 2092 on which three novel twisted blades 2010, 2020, 2030 can be mounted in an equally spaced configuration thereon. For example, the blades 2010, 2020, 2030 can be spaced approximately 120 degrees apart from one another. The blades 2010, 2020, 2030 can be separately molded and later fastened to the hub 2090 by conventional fasteners as described in the prior art. Alternatively, both the novel blades 2010, 2020, 2030 and hub 2090 can be molded together into the three blade assembly 2000. The blades 2010, 2020, 2030 can have slightly twisted configurations between their root end and their tip end, with both their leading edge and trailing edge having slight concave curved edges.

Table 8 shows the blade platform definition along twenty one (21) different station points along the novel small blade AC-D used in the blade assemblies.

TABLE 8

| Blade planform definition | | | |
|---|---|---|---|
| Station | Radius Meters | Chord Meters | Twist Degrees |
| 1 | 0.0825 | 0.2028 | 34.74 |
| 2 | 0.0905 | 0.1664 | 33.31 |
| 3 | 0.0984 | 0.1478 | 32.19 |
| 4 | 0.1064 | 0.1359 | 31.14 |
| 5 | 0.1143 | 0.1275 | 30.16 |
| 6 | 0.1222 | 0.1211 | 29.25 |
| 7 | 0.1302 | 0.1161 | 28.39 |
| 8 | 0.1381 | 0.1121 | 27.60 |
| 9 | 0.1461 | 0.1088 | 26.85 |
| 10 | 0.1540 | 0.1061 | 26.15 |
| 11 | 0.1619 | 0.1038 | 25.49 |
| 12 | 0.1699 | 0.1018 | 24.88 |
| 13 | 0.1778 | 0.1002 | 24.29 |
| 14 | 0.1857 | 0.0987 | 23.74 |
| 15 | 0.1937 | 0.0975 | 23.23 |
| 16 | 0.2016 | 0.0964 | 22.73 |
| 17 | 0.2095 | 0.0955 | 22.27 |
| 18 | 0.2175 | 0.0947 | 21.82 |
| 19 | 0.2254 | 0.0941 | 21.40 |
| 20 | 0.2334 | 0.0935 | 21.00 |
| 21 | 0.2413 | 0.0931 | 20.62 |

Table 8 summarizes the condenser fan blade geometries. Slicing the novel 19 inch blade into 21 sections from the root end to the tip end would include X/C and Y/C coordinates.

The following Table 8RP shows the coordinate columns represent the X/C and Y/C coordinates for the root end station portion (where the blades meet the hub) of the novel twisted blades for a standard fan size. These coordinates are given in a non-dimensional format, were x refers to the horizontal position, y refers to the vertical position and c is the chord length between the stations.

TABLE 8

| RP-X/C and Y/C coordinates for Root End Station Airfoil coordinates at station 1 | |
|---|---|
| X/C | Y/C |
| 1.00000 | 0.00000 |
| 0.99906 | 0.00189 |
| 0.99622 | 0.00522 |
| 0.99141 | 0.01000 |
| 0.98465 | 0.01565 |
| 0.97597 | 0.02231 |
| 0.96541 | 0.02966 |
| 0.95302 | 0.03773 |
| 0.93883 | 0.04629 |
| 0.92291 | 0.05530 |
| 0.90531 | 0.06456 |
| 0.88611 | 0.07404 |
| 0.86539 | 0.08355 |
| 0.84322 | 0.09302 |
| 0.81969 | 0.10233 |
| 0.79489 | 0.11138 |
| 0.76892 | 0.12005 |
| 0.74187 | 0.12824 |
| 0.71385 | 0.13584 |
| 0.68497 | 0.14278 |
| 0.65534 | 0.14896 |
| 0.62507 | 0.15431 |
| 0.59428 | 0.15877 |
| 0.56309 | 0.16228 |
| 0.53162 | 0.16480 |
| 0.50000 | 0.16630 |
| 0.46835 | 0.16676 |
| 0.43679 | 0.16617 |
| 0.40546 | 0.16453 |
| 0.37448 | 0.16187 |
| 0.34398 | 0.15818 |
| 0.31408 | 0.15355 |
| 0.28491 | 0.14798 |
| 0.25659 | 0.14160 |
| 0.22923 | 0.13444 |
| 0.20296 | 0.12660 |
| 0.17789 | 0.11814 |
| 0.15412 | 0.10916 |
| 0.13177 | 0.09971 |
| 0.11093 | 0.08995 |
| 0.09168 | 0.07993 |
| 0.07412 | 0.06987 |
| 0.05829 | 0.05986 |
| 0.04427 | 0.05011 |
| 0.03210 | 0.04067 |
| 0.02184 | 0.03177 |
| 0.01353 | 0.02337 |
| 0.00719 | 0.01586 |
| 0.00283 | 0.00918 |
| 0.00043 | 0.00396 |
| 0.00000 | 0.00000 |
| 0.00154 | −0.00059 |
| 0.00506 | −0.00007 |
| 0.01052 | 0.00191 |
| 0.01788 | 0.00487 |
| 0.02710 | 0.00898 |
| 0.03812 | 0.01395 |
| 0.05090 | 0.01981 |
| 0.06540 | 0.02628 |
| 0.08156 | 0.03336 |
| 0.09930 | 0.04087 |
| 0.11856 | 0.04877 |
| 0.13926 | 0.05693 |
| 0.16133 | 0.06525 |
| 0.18469 | 0.07358 |
| 0.20925 | 0.08181 |
| 0.23494 | 0.08978 |
| 0.26166 | 0.09737 |
| 0.28931 | 0.10447 |
| 0.31780 | 0.11096 |
| 0.34700 | 0.11678 |
| 0.37683 | 0.12185 |
| 0.40716 | 0.12610 |
| 0.43787 | 0.12947 |

TABLE 8-continued

| RP-X/C and Y/C coordinates for Root End Station Airfoil coordinates at station 1 | |
|---|---|
| X/C | Y/C |
| 0.46886 | 0.13189 |
| 0.50000 | 0.13333 |
| 0.53117 | 0.13377 |
| 0.56224 | 0.13320 |
| 0.59310 | 0.13164 |
| 0.62362 | 0.12910 |
| 0.65368 | 0.12563 |
| 0.68315 | 0.12127 |
| 0.71193 | 0.11608 |
| 0.73988 | 0.11013 |
| 0.76691 | 0.10351 |
| 0.79290 | 0.09630 |
| 0.81774 | 0.08861 |
| 0.84133 | 0.08054 |
| 0.86358 | 0.07220 |
| 0.88440 | 0.06373 |
| 0.90371 | 0.05524 |
| 0.92142 | 0.04690 |
| 0.93748 | 0.03877 |
| 0.95181 | 0.03107 |
| 0.96436 | 0.02381 |
| 0.97508 | 0.01727 |
| 0.98393 | 0.01140 |
| 0.99088 | 0.00656 |
| 0.99590 | 0.00266 |
| 0.99896 | 0.00026 |
| 1.00000 | −0.00123 |
| 1.00000 | 0.00123 |

The following Table 8TE shows the coordinate columns representing the X/C and Y/C coordinates for the tip end station section of the 21 sections of the novel twisted blades for an approximately 850 rpm running blades. These coordinates are given in a non-dimensional format, were x refers to the horizontal position, y refers to the vertical position and c is the chord length between the stations.

TABLE 8

| PE-X/C and Y/C coordinates for Tip End Station Airfoil coordinates at station 21 | |
|---|---|
| X/C | Y/C |
| 1.00000 | 0.00000 |
| 0.99906 | 0.00122 |
| 0.99622 | 0.00329 |
| 0.99141 | 0.00599 |
| 0.98465 | 0.00900 |
| 0.96597 | 0.01598 g1E |
| 0.95302 | 0.01974 |
| 0.93883 | 0.02363 |
| 0.92291 | 0.02762 |
| 0.90531 | 0.03163 |
| 0.88611 | 0.03566 |
| 0.86539 | 0.03964 |
| 0.84322 | 0.04357 |
| 0.81969 | 0.04740 |
| 0.79489 | 0.05113 |
| 0.76892 | 0.05472 |
| 0.74187 | 0.05812 |
| 0.71385 | 0.06132 |
| 0.68497 | 0.06430 |
| 0.65534 | 0.06702 |
| 0.62507 | 0.06947 |
| 0.59428 | 0.07162 |
| 0.56309 | 0.07346 |
| 0.53162 | 0.07496 |
| 0.50000 | 0.07613 |
| 0.46835 | 0.07692 |
| 0.43679 | 0.07735 |

TABLE 8-continued

| PE-X/C and Y/C coordinates for Tip End Station Airfoil coordinates at station 21 | |
|---|---|
| X/C | Y/C |
| 0.40546 | 0.07739 |
| 0.37448 | 0.07703 |
| 0.34398 | 0.07624 |
| 0.31408 | 0.07506 |
| 0.28491 | 0.07346 |
| 0.25659 | 0.07148 |
| 0.22923 | 0.06911 |
| 0.20296 | 0.06635 |
| 0.17789 | 0.06322 |
| 0.15412 | 0.05970 |
| 0.13177 | 0.05581 |
| 0.11093 | 0.05157 |
| 0.09168 | 0.04700 |
| 0.07412 | 0.04220 |
| 0.05829 | 0.03720 |
| 0.04427 | 0.03211 |
| 0.03210 | 0.02696 |
| 0.02184 | 0.02184 |
| 0.01353 | 0.01673 |
| 0.00719 | 0.01185 |
| 0.00283 | 0.00725 |
| 0.00043 | 0.00330 |
| 0.00000 | 0.00000 |
| 0.00154 | −0.00126 |
| 0.00506 | −0.00201 |
| 0.01052 | −0.00211 |
| 0.01788 | −0.00180 |
| 0.02710 | −0.00099 |
| 0.03812 | 0.00019 |
| 0.05090 | 0.00174 |
| 0.06540 | 0.00353 |
| 0.08156 | 0.00557 |
| 0.09930 | 0.00780 |
| 0.11856 | 0.01023 |
| 0.13926 | 0.01282 |
| 0.16133 | 0.01556 |
| 0.18469 | 0.01839 |
| 0.20925 | 0.02126 |
| 0.23494 | 0.02411 |
| 0.26166 | 0.02687 |
| 0.28931 | 0.0253 |
| 0.31780 | 0.03201 |
| 0.34700 | 0.03434 |
| 0.37683 | 0.03646 |
| 0.40716 | 0.03836 |
| 0.43787 | 0.04001 |
| 0.46886 | 0.04137 |
| 0.50000 | 0.04243 |
| 0.53117 | 0.04316 |
| 0.56224 | 0.04356 |
| 0.59310 | 0.04363 |
| 0.62362 | 0.04335 |
| 0.65368 | 0.04274 |
| 0.68315 | 0.04179 |
| 0.71193 | 0.04052 |
| 0.73988 | 0.03893 |
| 0.76691 | 0.03706 |
| 0.79290 | 0.03490 |
| 0.81774 | 0.03249 |
| 0.84133 | 0.02986 |
| 0.86358 | 0.02703 |
| 0.88440 | 0.02407 |
| 0.90371 | 0.02100 |
| 0.92142 | 0.01788 |
| 0.93748 | 0.01475 |
| 0.95181 | 0.01169 |
| 0.96436 | 0.00870 |
| 0.97508 | 0.00591 |
| 0.98393 | 0.00333 |
| 0.99088 | 0.00112 |
| 0.99590 | −0.00072 |

TABLE 8-continued

| PE-X/C and Y/C coordinates for Tip End Station Airfoil coordinates at station 21 | |
|---|---|
| X/C | Y/C |
| 0.99896 | −0.00186 |
| 1.00000 | −0.00269 |
| 1.00000 | 0.00269 |

Referring to Tables 8, 8RE and 8PE, there are twenty one (21) stations equally spaced along the blade length. The column entitled Radius meter includes the distance in meters from the root end of the blade to station 1 (horizontal line across the blade). Column entitled Chord Meters includes the width component of the blade at that particular station. Twist degrees is the pitch of the twist of the blades relative to the hub with the degrees given in the direction of blade rotation.

The comparative performance of the blades shown in FIGS. 32-36 are shown in Table 1, and the dimensions for these blades are shown in Table 2.

Figure 39:
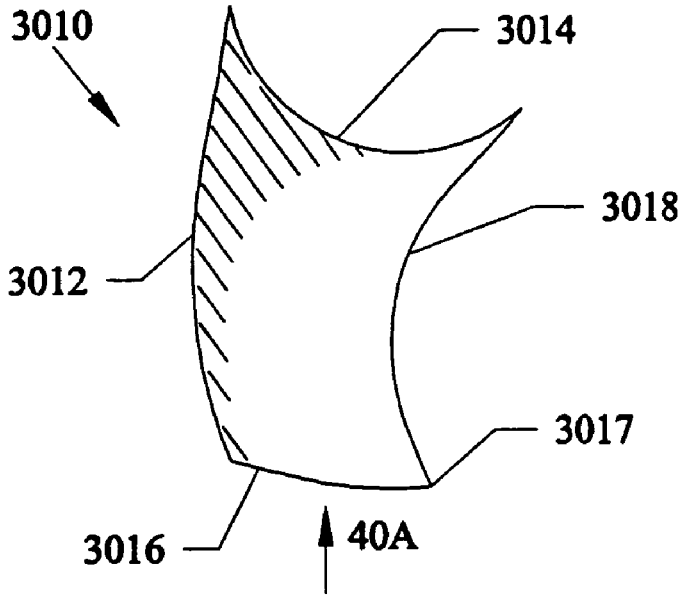
FIG. 39 is a top view of a single condenser blade of FIGS. 37-38.
Figure 40:
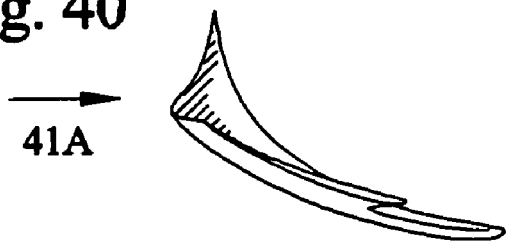
FIG. 40 is a tip end view of the single blade of FIG. 39 along arrow 40A.
Figure 41:
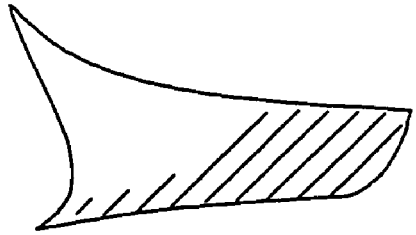
FIG. 41 is a side view of the single blade of FIG. 40 along arrow 41A.

FIG. 37 is a bottom perspective view of still another preferred embodiment of a three condenser blade assembly 3000 of the invention. FIG. 38 is a side view of the three blade assembly 3000 of FIG. 37 along arrow 38A. FIG. 39 is a top view of a single condenser blade 3010 of FIGS. 37-38. FIG. 40 is a tip end view of the single blade 3010 of FIG. 39 along arrow 40A. FIG. 41 is a side view of the single blade 3010 of FIG. 40 along arrow 41A.

Referring to FIGS. 37-41, a central hub 3090 can include a bottom end 3095 for attaching the assembly 3000 to standard or novel condenser housing, such as those previously described. The central hub 3090 can include a top end 3097 and sides 3092 on which three novel twisted blades 3010, 3020, 3030 can be mounted in an equally spaced configuration thereon. For example, the blades 3010, 3020, 3030 can be spaced approximately 120 degrees apart from one another. The blades 3010, 3020, 3030 can be separately molded and later fastened to the hub 3090 by conventional fasteners as described in the prior art. Alternatively, both the novel blades 3010, 3020, 3030 and hub 3090 can be molded together into the three blade assembly 3000. The blades 3010, 3020, 3030 can have slightly twisted configurations between their root end 3014 and their tip end 3016. The tip end 3016 can have a sharp angled hook end 3017 The leading edge 3012 can have a convex curved shaped edge, and the trailing edge 3018 can have a concave curved shaped edge with both their leading edge and trailing edge having slight concave curved edges.

Table 9 shows the blade platform definition along twenty one (21) different station points along the novel small blade AC-E used in the blade assemblies.

TABLE 9

| Blade planform definition | | | |
|---|---|---|---|
| Station | Radius Meters | Chord Meters | Twist Degrees |
| 1 | 0.0825 | 0.2056 | 30.88 |
| 2 | 0.0905 | 0.1697 | 31.13 |
| 3 | 0.0984 | 0.1514 | 30.86 |
| 4 | 0.1064 | 0.1397 | 30.37 |
| 5 | 0.1143 | 0.1316 | 29.79 |
| 6 | 0.1222 | 0.1256 | 29.18 |
| 7 | 0.1302 | 0.1209 | 28.56 |
| 8 | 0.1381 | 0.1173 | 27.96 |
| 9 | 0.1461 | 0.1144 | 27.37 |

TABLE 9-continued

| Blade planform definition | | | |
|---|---|---|---|
| Station | Radius Meters | Chord Meters | Twist Degrees |
| 10 | 0.1540 | 0.1120 | 26.80 |
| 11 | 0.1619 | 0.1100 | 26.26 |
| 12 | 0.1699 | 0.1084 | 25.74 |
| 13 | 0.1778 | 0.1071 | 25.24 |
| 14 | 0.1857 | 0.1060 | 24.76 |
| 15 | 0.1937 | 0.1051 | 24.31 |
| 16 | 0.2016 | 0.1044 | 23.87 |
| 17 | 0.2095 | 0.1038 | 23.46 |
| 18 | 0.2175 | 0.1033 | 23.06 |
| 19 | 0.2254 | 0.1030 | 22.68 |
| 20 | 0.2334 | 0.1028 | 22.31 |
| 21 | 0.2413 | 0.1026 | 21.96 |

Table 9 summarizes the condenser fan blade geometries. Slicing the novel blade into 21 sections from the root end to the tip end would include X/C and Y/C coordinates.

The following Table 9RP shows the coordinate columns represent the X/C and Y/C coordinates for the root end station portion (where the blades meet the hub) of the novel twisted blades for a standard fan size. These coordinates are given in a non-dimensional format, were x refers to the horizontal position, y refers to the vertical position and c is the chord length between the stations.

TABLE 9

| RP-X/C and Y/C coordinates for Root End Station Airfoil coordinates at station 1 | |
|---|---|
| X/C | Y/C |
| 1.0000000 | 0.0000000 |
| 0.9990622 | 0.0018682 |
| 0.9962202 | 0.0051464 |
| 0.9914120 | 0.0098320 |
| 0.9846538 | 0.0153492 |
| 0.9759777 | 0.0218545 |
| 0.9654204 | 0.0290090 |
| 0.9530243 | 0.0368630 |
| 0.9388363 | 0.0451692 |
| 0.9229154 | 0.0539163 |
| 0.9053209 | 0.0629033 |
| 0.8861247 | 0.0720830 |
| 0.8653995 | 0.0812943 |
| 0.8432288 | 0.0904721 |
| 0.8196995 | 0.0994782 |
| 0.7949016 | 0.1082381 |
| 0.7689289 | 0.1166289 |
| 0.7418829 | 0.1245540 |
| 0.7138656 | 0.1319137 |
| 0.6849843 | 0.1386323 |
| 0.6553511 | 0.1446186 |
| 0.6250807 | 0.1498075 |
| 0.5942894 | 0.1541349 |
| 0.5630973 | 0.1575542 |
| 0.5316256 | 0.1600199 |
| 0.5000000 | 0.1615026 |
| 0.4683447 | 0.1619777 |
| 0.4367849 | 0.1614424 |
| 0.4054491 | 0.1599009 |
| 0.3744643 | 0.1573638 |
| 0.3439574 | 0.1538417 |
| 0.3140548 | 0.1493985 |
| 0.2848806 | 0.1440481 |
| 0.2565540 | 0.1379109 |
| 0.2291970 | 0.1310123 |
| 0.2029217 | 0.1234501 |
| 0.1778443 | 0.1152875 |
| 0.1540753 | 0.1066033 |
| 0.1317218 | 0.0974559 |

TABLE 9-continued

| RP-X/C and Y/C coordinates for Root End Station Airfoil coordinates at station 1 | |
|---|---|
| X/C | Y/C |
| 0.1108777 | 0.0879859 |
| 0.0916343 | 0.0782633 |
| 0.0740680 | 0.0684863 |
| 0.0582456 | 0.0587339 |
| 0.0442256 | 0.0492309 |
| 0.0320634 | 0.0400120 |
| 0.0218093 | 0.0313069 |
| 0.0135045 | 0.0230685 |
| 0.0071701 | 0.0156888 |
| 0.0028132 | 0.0090979 |
| 0.0004270 | 0.0039433 |
| 0.0000000 | 0.0000000 |
| 0.0015470 | −0.0006081 |
| 0.0050728 | −0.0001446 |
| 0.0105419 | 0.0017504 |
| 0.0179115 | 0.0045779 |
| 0.0271347 | 0.0085302 |
| 0.0381606 | 0.0133076 |
| 0.0509464 | 0.0189472 |
| 0.0654484 | 0.0251767 |
| 0.0816040 | 0.0319936 |
| 0.0993477 | 0.0392221 |
| 0.1186083 | 0.0468347 |
| 0.1393102 | 0.0546877 |
| 0.1613767 | 0.0627052 |
| 0.1847317 | 0.0707369 |
| 0.2092923 | 0.0786790 |
| 0.2349770 | 0.0863690 |
| 0.2616920 | 0.0936894 |
| 0.2893394 | 0.1005447 |
| 0.3178212 | 0.1068141 |
| 0.3470246 | 0.1124503 |
| 0.3768457 | 0.1173546 |
| 0.4071689 | 0.1214779 |
| 0.4378811 | 0.1247492 |
| 0.4688653 | 0.1271159 |
| 0.5000000 | 0.1285386 |
| 0.5311644 | 0.1289973 |
| 0.5622367 | 0.1284851 |
| 0.5930926 | 0.1270161 |
| 0.6236093 | 0.1246086 |
| 0.6536649 | 0.1212978 |
| 0.6831397 | 0.1171327 |
| 0.7119144 | 0.1121614 |
| 0.7398711 | 0.1064605 |
| 0.7668971 | 0.1001009 |
| 0.7928844 | 0.0931763 |
| 0.8177245 | 0.0857712 |
| 0.8413172 | 0.0780045 |
| 0.8635685 | 0.0699629 |
| 0.8843893 | 0.0618007 |
| 0.9036951 | 0.0535990 |
| 0.9214126 | 0.0455369 |
| 0.9374697 | 0.0376758 |
| 0.9518037 | 0.0302150 |
| 0.9643556 | 0.0231800 |
| 0.9750783 | 0.0168262 |
| 0.9839302 | 0.0111195 |
| 0.9908760 | 0.0064128 |
| 0.9958938 | 0.0026006 |
| 0.9989638 | 0.0002534 |
| 1.0000000 | −0.0012160 |
| 1.0000000 | 0.0012160 |

The following Table 9PE shows the coordinate columns representing the X/C and Y/C coordinates for the tip end station section of the 21 sections of the novel twisted blades for an approximately 850 rpm running blades. These coordinates are given in a non-dimensional format, were x refers to the horizontal position, y refers to the vertical position and c is the chord length between the stations.

TABLE 9

| PE-X/C and Y/C coordinates for Tip End Station Airfoil coordinates at station 21 | |
|---|---|
| X/C | Y/C |
| 1.0000000 | 0.0000000 |
| 0.9990622 | 0.0012220 |
| 0.9962202 | 0.0033026 |
| 0.9914120 | 0.0060205 |
| 0.9846538 | 0.0090521 |
| 0.9759777 | 0.0124535 |
| 0.9654204 | 0.0160582 |
| 0.9530243 | 0.0198822 |
| 0.9388363 | 0.0238107 |
| 0.9229154 | 0.0278488 |
| 0.9053209 | 0.0319086 |
| 0.8861247 | 0.0359815 |
| 0.8653995 | 0.0400131 |
| 0.8432288 | 0.0439906 |
| 0.8196995 | 0.0478757 |
| 0.7949016 | 0.0516559 |
| 0.7689289 | 0.0552871 |
| 0.7418829 | 0.0587318 |
| 0.7138656 | 0.0619759 |
| 0.6849843 | 0.0649878 |
| 0.6553511 | 0.0677435 |
| 0.6250807 | 0.0702202 |
| 0.5942894 | 0.0723914 |
| 0.5630973 | 0.0742447 |
| 0.5316256 | 0.0757608 |
| 0.5000000 | 0.0769252 |
| 0.4683447 | 0.0777186 |
| 0.4367849 | 0.0781329 |
| 0.4054491 | 0.0781574 |
| 0.3744643 | 0.0777765 |
| 0.3439574 | 0.0769666 |
| 0.3140548 | 0.0757540 |
| 0.2848806 | 0.0741103 |
| 0.2565540 | 0.0720886 |
| 0.2291970 | 0.0696705 |
| 0.2029217 | 0.0668680 |
| 0.1778443 | 0.0636851 |
| 0.1540753 | 0.0601220 |
| 0.1317218 | 0.0561747 |
| 0.1108777 | 0.0518844 |
| 0.0916343 | 0.0472689 |
| 0.0740680 | 0.0424188 |
| 0.0582456 | 0.0373753 |
| 0.0442256 | 0.0322501 |
| 0.0320634 | 0.0270611 |
| 0.0218093 | 0.0219060 |
| 0.0135045 | 0.0167714 |
| 0.0071701 | 0.0118773 |
| 0.0028132 | 0.0072541 |
| 0.0004270 | 0.0032971 |
| 0.0000000 | 0.0000000 |
| 0.0015470 | −0.0012555 |
| 0.0050728 | −0.0019932 |
| 0.0105419 | −0.0020720 |
| 0.0179115 | −0.0017384 |
| 0.0271347 | −0.0009006 |
| 0.0381606 | 0.0003139 |
| 0.0509464 | 0.0019083 |
| 0.0654484 | 0.0037426 |
| 0.0816040 | 0.0058311 |
| 0.0993477 | 0.0081111 |
| 0.1186083 | 0.0105931 |
| 0.1393102 | 0.0132410 |
| 0.1613767 | 0.0160313 |
| 0.1847317 | 0.0189132 |
| 0.2092923 | 0.0218452 |
| 0.2349770 | 0.0247440 |
| 0.2616920 | 0.0275508 |
| 0.2893394 | 0.0302564 |
| 0.3178212 | 0.0327839 |
| 0.3470246 | 0.0351534 |

TABLE 9-continued

| PE-X/C and Y/C coordinates for Tip End Station Airfoil coordinates at station 21 | | |
|---|---|---|
| X/C | Y/C | |
| 0.3768457 | 0.0373088 | |
| 0.4071689 | 0.0392384 | |
| | 0.0409059 v iDB | 0.4378811 |
| 0.4688653 | 0.0422847 | |
| 0.5000000 | 0.0433509 | |
| 0.5311644 | 0.0440895 | |
| 0.5622367 | 0.0444887 | |
| 0.5930926 | 0.0445479 | |
| 0.6236093 | 0.0442592 | |
| 0.6536649 | 0.0436237 | |
| 0.6831397 | 0.0426531 | |
| 0.7119144 | 0.0413533 | |
| 0.7398711 | 0.0397338 | |
| 0.7668971 | 0.0378218 | |
| 0.7928844 | 0.0356251 | |
| 0.8177245 | 0.0331693 | |
| 0.8413172 | 0.0304948 | |
| 0.8635685 | 0.0276264 | |
| 0.8843893 | 0.0246186 | |
| 0.9036951 | 0.0215002 | |
| 0.9214126 | 0.0183438 | |
| 0.9374697 | 0.0151720 | |
| 0.9518037 | 0.0120716 | |
| 0.9643556 | 0.0090513 | |
| 0.9750783 | 0.0062344 | |
| 0.9839302 | 0.0036208 | |
| 0.9908760 | 0.0013914 | |
| 0.9958938 | −0.0004591 | |
| 0.9989638 | −0.0016123 | |
| 1.0000000 | −0.0024366 | |
| 1.0000000 | 0.0024366 | |

Referring to Tables 9, 9RE and 9PE, there are twenty one (21) stations equally spaced along the blade length. The column entitled Radius meter includes the distance in meters from the root end of the blade to station 1 (horizontal line across the blade). Column entitled Chord Meters includes the width component of the blade at that particular station. Twist degrees is the pitch of the twist of the blades relative to the hub with the degrees given in the direction of blade rotation.

The comparative performance of the blades shown in FIGS. 37-41 are shown in Table 1, and the dimensions for these blades are shown in Table 2.

Figure 42:
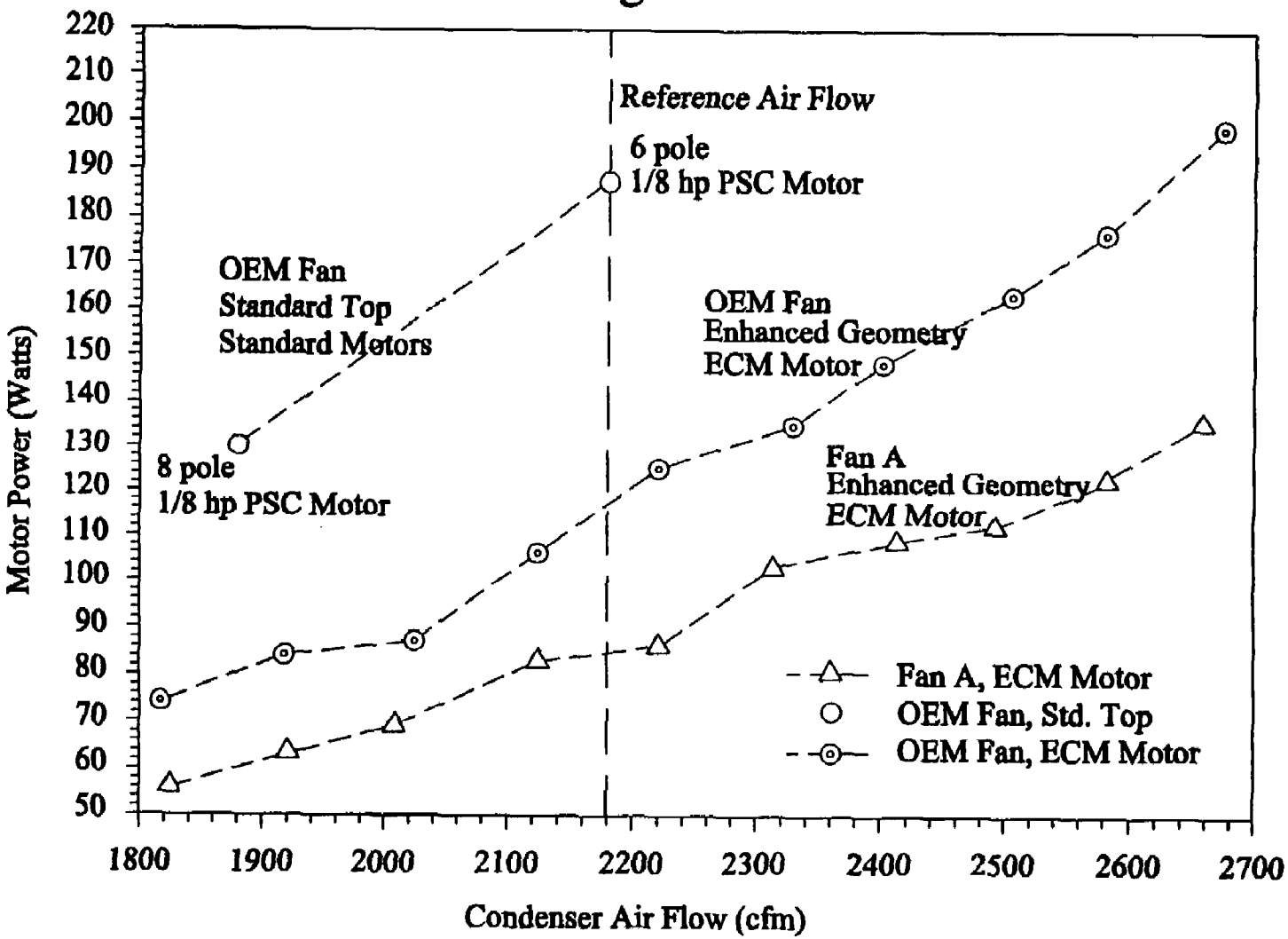
FIG. 42 is a graph of performance with ECM motors in the fan embodiments in condenser airflow (cfm) versus motor power (Watts).

FIG. 42 is a graph of performance with ECM motors in the fan embodiments in condenser airflow (cfm) versus motor power (Watts). This figure shows the performance of the standard OEM fan in air moving performance and energy efficiency (approximately 190 Watts to produce approximately 2180 cfm) against the same exact OEM fan with an ECM motor with the conical diffuser (approximately 120 Watts to produce the same flow). This shows the efficiency of the ECM motor and the diffuser assembly. However, when simply substituting Fan A5 with the same assembly, energy use is further reduced to approximately 84 Watts to produce the reference flow. This shows that while the ECM motor and diffuser assembly can produce a large reduction in energy use (approximately 37%), adding the more efficient fan blades of A5 produces a further improvement in efficiency, cutting total power by more than approximately 100 Watts and reducing fan energy use by approximately 55%.

Figure 43:
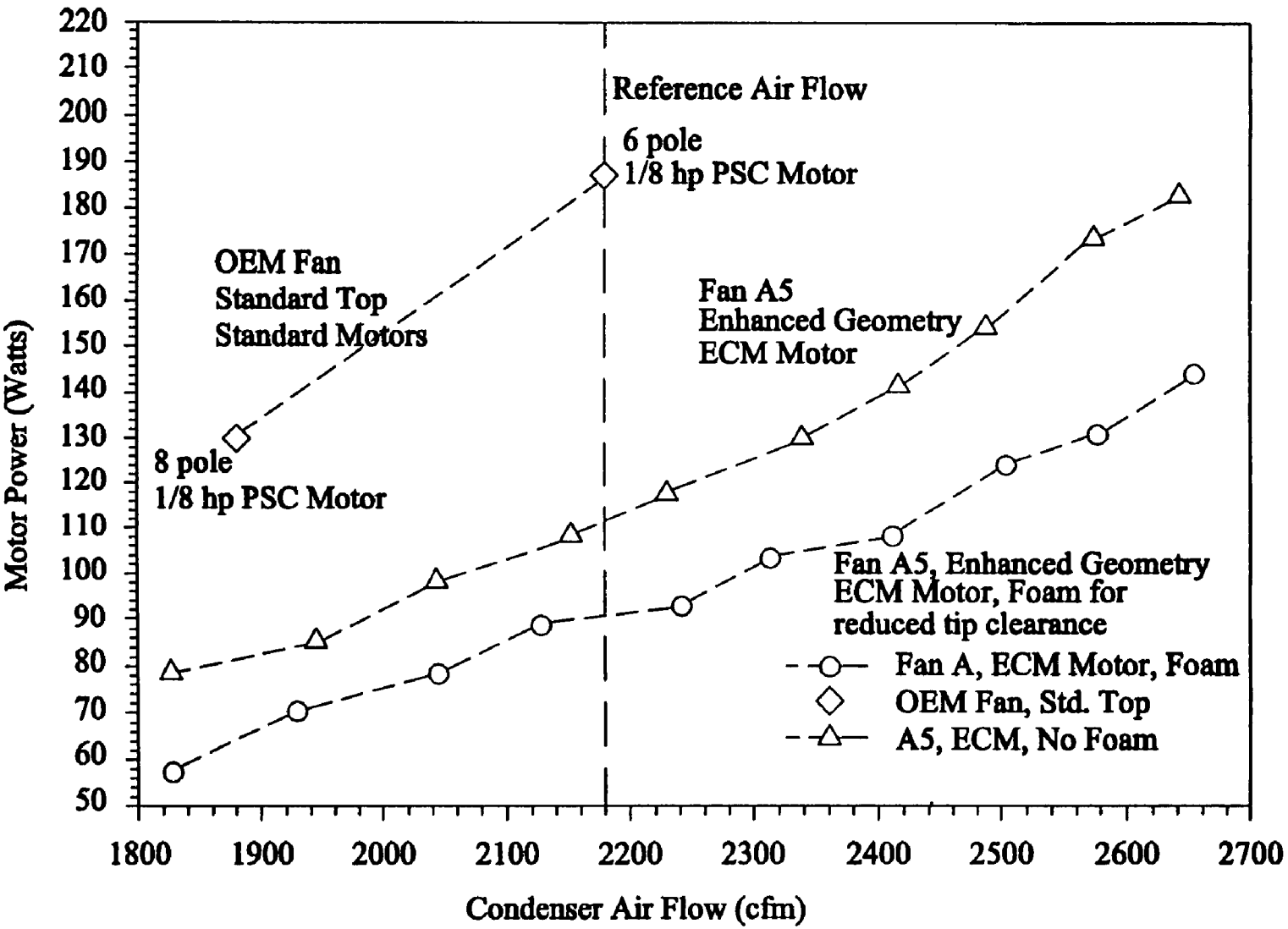
FIG. 43 is a graph of impact of the reduced blade tip clearance from use of the foam strip of the fan embodiments in condenser airflow (cfm) versus motor power (Watts).

FIG. 43 is a graph of impact of the reduced blade tip clearance from use of the foam strip of the fan embodiments in condenser airflow (cfm) versus motor power (Watts). This shows the same performance data for the OEM fan plotted as diamonds. Two separate plots show the performance of Fan A5 with the variable speed ECM motor, with and without the tip clearance and sound control strip on the diffuser side walls. Note the large impact on air moving efficiency. To reach approximately 2200 cfm, the reference air flow for the AC unit, requires approximately 112 Watts without the fan tip clearance strip with the conical diffuser, but only about approximately 88 Watts with the enhancement.

Figure 44:
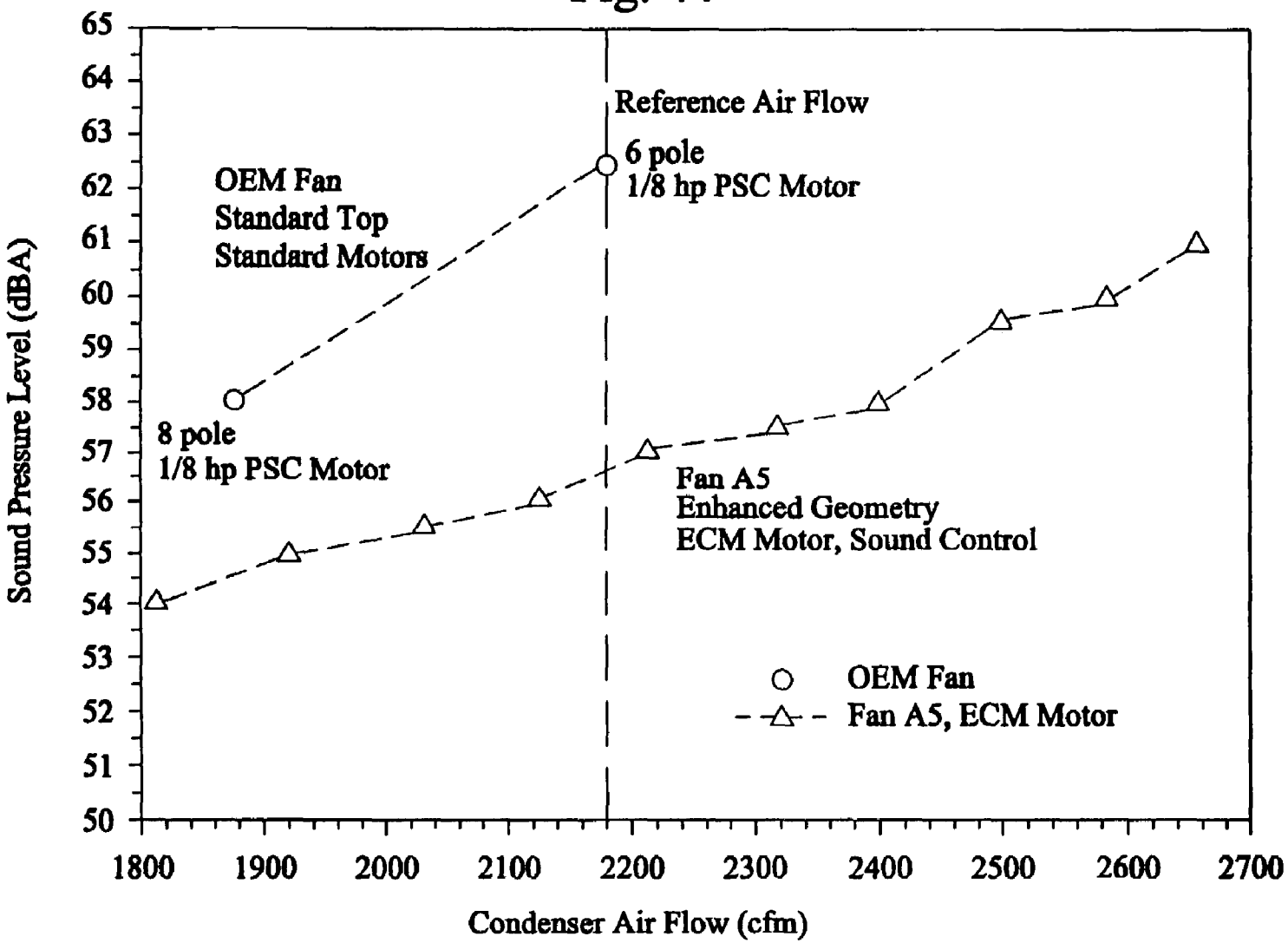
FIG. 44 is a graph of the impact on sound of the fan embodiments in condenser airflow (cfm) versus sound pressure level (dBA).

FIG. 44 is a graph of the impact on sound of the fan embodiments in condenser airflow (cfm) versus sound pressure level (dBA). This plot shows the measured sound level of the fan only of the air conditioners when measured according to ARI 270-1995. The standard fan with standard top shows a measured sound level of about approximately 62.5 dBA. However, asymmetrical fan A5 with the sound control strip shows a recorded sound level of only about approximately 67 dBA over an approximately 30% reduction in perceived sound level.

Figure 45:
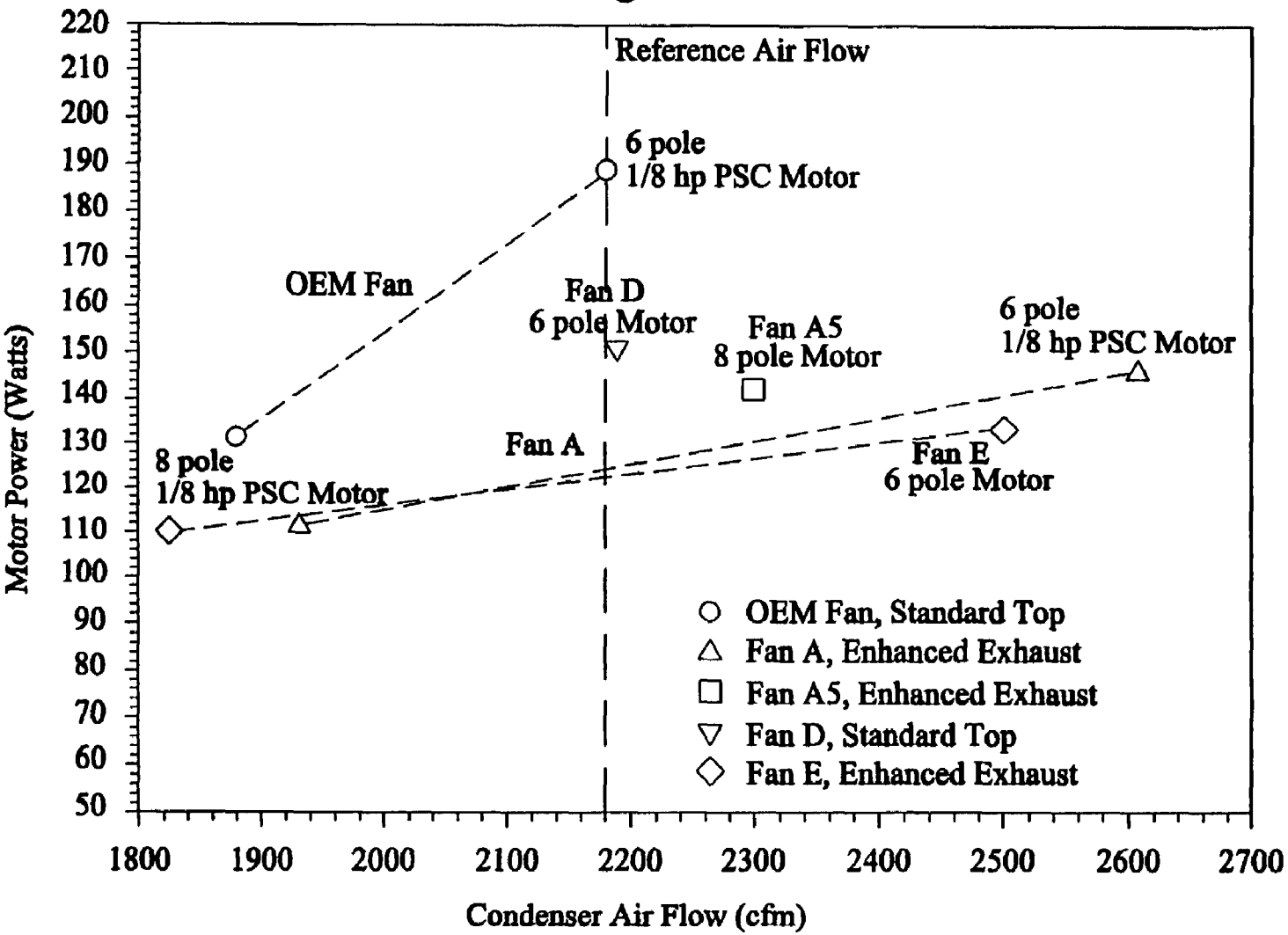
FIG. 45 is a graph of relative fan performance of the fan embodiments in condenser airflow (cfm) versus motor power (Watts).

FIG. 45 is a graph of relative fan performance of the fan embodiments in condenser airflow (cfm) versus motor power (Watts). This figure shows the comparative air moving performance and relative energy efficiency of the various tested fans against the standard OEM (original equipment manufacturer) metal blades when using the original air conditioner "starburst" top. The OEM fan performance test points are shown as two circles connected by a dotted line. The higher flow value (approximately 2180 cfm and approximately 190 Watts) shows the standard air conditioner configuration with a ⅛ hp PSC 6-pole motor operating at approximately 1000 rpm. The lower point at approximately 1880 cfm and approximately 130 Watts shows the performance when matched with an 8-pole motor.

The individual plotted point for Fan D shows its performance with the same 6-pole motor above and with the standard starburst top. Note that air moving performance is slightly better than the standard fan while the power use of the identical motor is reduced by approximately 40 Watts (approximately 21%).

The plotted points for Fan A (open triangle: 3 twisted, tapered air foil blades) show performance with exactly the same 6 and 8 pole motors, but with the conical diffuser assembly with all flow enhancements. Note the much higher flow and lower power. With the same six pole motor, Fan A produces a flow of over approximately 2600 cfm at a power draw of only approximately 145 Watts. Thus, this configuration provides even greater energy savings and flow increased by over approximately 400 cfm which improves air conditioner performance under peak conditions. A similar plot is shown for Fan E with the same motors.

The single point for Fan A5 shows the five-bladed asymmetrical fan operating with the 8 pole ⅛ hp motor with the diffuser and enhancements. Note that even though the fan is turning more slowly (rpm=approximately 850), the fan produces approximately 2300 cfm—more than the standard configuration, plus a power savings of over approximately 49 W (approximately 26%). This fan has the large advantage of also being much more quiet in operation than the standard fan given its slow operating speed, asymmetrical design and use of sound suppression on the diffuser side wall.

Although the invention describes embodiments for air conditioner condenser systems, the invention can be used with blades for heat pumps, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An improved air conditioner condenser or heat pump fan assembly consisting essentially of:

a diffuser housing having an opening therethrough and interior walls therethrough;

a plurality of rotating blades attached to a hub, the hub being mounted in the diffuser housing, each of the blades having a leading edge, a tip edge and a trailing edge;

an approximately 1 and ½ inch wide and approximately 3/16 inch thick plastic single foam strip attached to line completely around the interior walls of the diffuser housing where the tips of the blades sweep closest to the interior walls, the foam strip reducing spacing between the tips of the rotating blades and the interior walls of the housing, the foam strip for both increasing air flow of up to approximately 15% and increasing air moving efficiency of up to approximately 45%, and also for reducing sound noise emissions from the housing;

tip plastic foam strips attached to all of each tip edge of the rotating blades;

trailing edge plastic foam strips attached to all of each trailing edge of the rotating blades, the tip foam strips and the trailing edge foam strips for additionally reducing sound noise emissions from the housing and for increasing air flow from the rotating blades.

2. The improved air conditioner condenser or heat pump fan assembly of claim 1, wherein the tip plastic foam strips and the trailing edge plastic foam strips each include approximately 1 and ½ inch wide and approximately 3/16 inch thick plastic single foam strip.

3. The improved air conditioner condenser or heat pump fan assembly of claim 2, wherein the liner plastic foam strip and the tip plastic foam strips and the trailing edge plastic foam strips are open celled foam.

4. The improved air conditioner condenser or heat pump fan assembly of claim 2, wherein the plurality of the rotating blades have a diameter or between approximately 19 inches to approximately 27 inches.

5. An improved air conditioner condenser or heat pump fan assembly, consisting essentially of:

a diffuser housing having interior walls that form a diffuser having an outwardly expanding convex curved, conical shape for reducing undesirable sound noise emissions from the housing;

a single conical body member attached to an upper portion of the hub;

a plurality rotating blades attached to a hub, the hub being mounted in the diffuser housing, each of the blades having a leading edge, a tip edge and a trailing edge, wherein both the diffuser walls and the single conical body member reduce undesirable sound emissions that emanate from the rotating blades within the housing;

an approximately 1 and ½ inch wide and approximately 3/16 inch thick plastic single foam strip attached to line completely around the interior walls of the diffuser housing where the tips of the blades sweep closest to the interior walls, the foam strip reducing spacing between the tips of the rotating blades and the interior walls of the housing, the foam strip for both increasing air flow of up to approximately 15% and increasing air moving efficiency of up to approximately 45%, and also for reducing sound noise emissions from the housing;

tip plastic foam strips attached to all of each tip edge of the rotating blades;

trailing edge plastic foam strips attached to all of each trailing edge of the rotating blades, the tip foam strips and the trailing edge foam strips for additionally reducing sound noise emissions from the housing and for increasing air flow from the rotating blades.

6. The improved air conditioner condenser or heat pump fan assembly of claim 5, wherein the tip plastic foam strips and the trailing edge plastic foam strips each include approximately 1 and ½ inch wide and approximately 3/16 inch thick plastic single foam strip.

7. The improved air conditioner condenser or heat pump fan assembly of claim 6, wherein the liner plastic foam strip and the tip plastic foam strips and the trailing edge plastic foam strips are open celled foam.

8. The improved air conditioner condenser or heat pump fan assembly of claim 6, wherein the plurality of the rotating blades have a diameter or between approximately 19 inches to approximately 27 inches.

9. A method of reducing undesirable sound noise emissions and increasing airflow in an air conditioner condenser/heat pump fan assembly comprising the steps of:

providing a diffuser housing having an opening therethrough and interior walls therethrough;

providing a plurality of blades attached to a hub, the hub being mounted in the diffuser housing, each of the blades having a leading edge, a tip edge and a trailing edge;

mounting an approximately 1 and ½ inch wide and approximately 3/16 inch thick plastic single foam strip attached to tine completely around the interior walls of the diffuser housing where the tips of the blades sweep closest to the interior walls, the foam strip reducing spacing between the tips of the rotating blades and the interior walls of the housing, the foam strip for both increasing air flow of up to approximately 15% and increasing air moving efficiency of up to approximately 45%, and also for reducing sound noise emissions from the housing;

mounting tip plastic foam strips attached to all of each tip edge of the rotating blades;

trailing edge plastic foam strips attached to all of each trailing edge of the rotating blades, the tip foam strips and the trailing edge foam strips a porous member attached to at least one of the rotating blades and the housing for additionally reducing sound noise emissions from the housing and for increasing air flow from the rotating blades;

rotating the blades relative to the hub;

simultaneously reducing both the sound noise emissions from the rotating blades and the air flow from the rotating blades by the foam strips being mounted to the tips and trailing edges of the blades and by the foam strips being mounted along the interior walls of the housing being adjacent to the rotating blades; and reducing fan blade tip clearance of the rotating blades and interior walls of the housing with the foam strips mounted to the interior walls of the housing;

breaking up fan tip vortex shedding from the rotating blades with the foam strips being mounted along the interior walls of the housing;

increasing air flow of up to approximately 15% and increasing air moving efficiency of up to approximately 45% by the reduced spacing between the tips of the rotating blades and the interior walls of the housing.

10. The method of claim 9, wherein the tip plastic foam strips and the trailing edge plastic foam strips each include approximately 1 and ½ inch wide and approximately 3/16 inch thick plastic single foam strip.

11. The method of claim 10, wherein the liner plastic foam strip and the tip plastic foam strips and the trailing edge plastic foam strips are open celled foam.

12. The method of claim 10, wherein the plurality of the rotating blades have a diameter or between approximately 19 inches to approximately 27 inches.

* * * * *